US012686516B2

(12) United States Patent
Fox et al.

(10) Patent No.: US 12,686,516 B2
(45) Date of Patent: Jul. 21, 2026

(54) RANDOM CASE SEALER WITH CASE LIFTER

(71) Applicant: Signode Industrial Group LLC, Tampa, FL (US)

(72) Inventors: Bryce J. Fox, Honesdale, PA (US); William J. Menta, West Wyoming, PA (US); Joseph E. Lininger, Union Grove, WI (US); Paul Szadziewicz, Elmhurst, IL (US); Drew Wenrich, Cincinnati, OH (US)

(73) Assignee: Signode Industrial Group LLC, Tampa, FL (US)

( * ) Notice: Subject to any disclaimer, the term of this patent is extended or adjusted under 35 U.S.C. 154(b) by 96 days.

(21) Appl. No.: 18/550,501

(22) PCT Filed: Apr. 1, 2022

(86) PCT No.: PCT/US2022/071501
§ 371 (c)(1),
(2) Date: Sep. 14, 2023

(87) PCT Pub. No.: WO2022/217203
PCT Pub. Date: Oct. 13, 2022

(65) Prior Publication Data

US 2024/0166392 A1 May 23, 2024

Related U.S. Application Data

(60) Provisional application No. 63/171,785, filed on Apr. 7, 2021.

(51) Int. Cl.

| | |
|---|---|
| ***B65B 51/06*** | (2006.01) |
| ***B65B 57/02*** | (2006.01) |
| ***B65B 59/02*** | (2006.01) |

(52) U.S. Cl.
CPC ..... *B65B 51/067* (2013.01); *B65B 57/02* (2013.01); *B65B 59/02* (2013.01)

(58) Field of Classification Search
CPC ..... B65B 51/06; B65B 59/02; B65B 51/067
See application file for complete search history.

(56) References Cited

U.S. PATENT DOCUMENTS

| | | | |
|---|---|---|---|
| 3,892,618 | A | 7/1975 | Griebat |
| 3,915,786 | A | 10/1975 | Collett et al. |

(Continued)

FOREIGN PATENT DOCUMENTS

| | | | |
|---|---|---|---|
| CN | 201424150 | Y | 3/2010 |
| CN | 201424151 | Y | 3/2010 |

(Continued)

OTHER PUBLICATIONS

"International Search Report and Written Opinion", from corresponding patent application, No. PCT/US2022/071501, Jul. 27, 2022.

(Continued)

*Primary Examiner* — Daniel Jeremy Leeds
(74) *Attorney, Agent, or Firm* — Neal, Gerber & Eisenberg LLP

(57) ABSTRACT

Various embodiments of the present disclosure provide a random case sealer including a case lifter configured to lift a case out of engagement with a lower drive element 115 (such as a drive belt) of the case sealer as the case reaches a holding position beneath the top-head assembly 400 and, afterwards, to lower the case into engagement with the lower drive element once the top-head assembly has descended to within a designated distance of the top surface of the case. In certain of these embodiments, the case lifter includes a (Continued)

case blocker 215 positioned to stop the case from moving any further beneath the top-head assembly once it reaches the holding position.

13 Claims, 20 Drawing Sheets

(56) References Cited

U.S. PATENT DOCUMENTS

| | | | | |
|---|---|---|---|---|
| 3,954,550 | A | 5/1976 | Patterson | |
| 4,238,269 | A | 12/1980 | Deering | |
| 4,295,771 | A | 10/1981 | Mehesan | |
| 4,543,150 | A | 9/1985 | Marchetti | |
| 4,781,786 | A | 11/1988 | Lerner et al. | |
| 4,846,921 | A * | 7/1989 | Lerner | B65B 51/06 156/352 |
| 5,066,346 | A | 11/1991 | Long et al. | |
| 5,173,140 | A | 12/1992 | Vasilakes | |
| 5,227,002 | A | 7/1993 | Faust et al. | |
| 5,300,181 | A | 4/1994 | Yamaguchi | |
| 5,338,384 | A | 8/1994 | Reichert | |
| 5,454,776 | A | 10/1995 | Ulrich et al. | |
| 5,685,814 | A | 11/1997 | Le | |
| 6,910,314 | B2 | 6/2005 | Le | |
| 7,571,588 | B2 | 8/2009 | Sambuca et al. | |
| 7,819,357 | B2 | 10/2010 | Fox et al. | |
| 7,926,536 | B2 | 4/2011 | Fox et al. | |
| 7,937,905 | B2 | 5/2011 | Fox et al. | |
| 7,946,327 | B2 | 5/2011 | Fox et al. | |
| 7,946,328 | B2 | 5/2011 | Fox et al. | |
| 8,079,395 | B2 | 12/2011 | Fox et al. | |
| 8,452,852 | B2 | 5/2013 | Jachner | |
| 9,517,914 | B2 | 12/2016 | Menta et al. | |
| 9,630,796 | B2 | 4/2017 | Menta et al. | |
| 10,532,842 | B1 | 1/2020 | Zoss et al. | |
| 10,723,496 | B2 | 7/2020 | Riswick et al. | |
| 11,242,169 | B2 | 2/2022 | Menta et al. | |
| 11,358,744 | B2 | 6/2022 | Menta et al. | |
| 11,492,163 | B2 | 11/2022 | Menta et al. | |
| 2005/0235603 | A1 | 10/2005 | Le | |
| 2009/0021753 | A1 | 1/2009 | Ferman et al. | |
| 2009/0217535 | A1 | 9/2009 | Fox et al. | |
| 2009/0218047 | A1 | 9/2009 | Fox et al. | |
| 2009/0218048 | A1 | 9/2009 | Fox et al. | |
| 2010/0175836 | A1 | 7/2010 | Lam | |
| 2012/0102893 | A1 * | 5/2012 | Sambuca, Jr. | B65B 59/005 53/476 |
| 2019/0283914 | A1 | 9/2019 | Menta et al. | |
| 2020/0307841 | A1 * | 10/2020 | Pattuzzi | B65B 59/001 |
| 2021/0300611 | A1 | 9/2021 | Menta | |
| 2022/0063854 | A1 | 3/2022 | Bern et al. | |
| 2022/0081145 | A1 | 3/2022 | Chu et al. | |
| 2022/0161505 | A1 | 5/2022 | Hivatal et al. | |
| 2022/0396449 | A1 | 12/2022 | Russell et al. | |
| 2023/0089892 | A1 | 3/2023 | Johnson | |

FOREIGN PATENT DOCUMENTS

| | | | |
|---|---|---|---|
| CN | 101804924 | A | 8/2010 |
| CN | 207389701 | U | 5/2018 |
| CN | 108190127 | A | 6/2018 |
| CN | 208377251 | U | 1/2019 |
| DE | 3820060 | A1 | 12/1989 |
| DE | 60105613 | T2 | 10/2004 |
| EP | 0460878 | A2 | 12/1991 |
| GB | 1340175 | A | 12/1973 |
| JP | 2004276951 | A | 10/2004 |
| KR | 20080088029 | A | 10/2008 |

OTHER PUBLICATIONS

First Office Action and Search Report, from corresponding Chinese Patent Application No. 202280023318.4 with English translation, Apr. 14, 2025.

* cited by examiner

RANDOM CASE SEALER WITH CASE LIFTER

PRIORITY

This application is a national phase application of PCT/US2022/071501, filed on Apr. 1, 2022, which claims priority to and the benefit of U.S. Provisional Patent Application No. 63/171,785, filed Apr. 7, 2021, the entire contents of which is incorporated herein by reference.

FIELD

The present disclosure relates to case sealers, and more particularly to random case sealers configured to seal cases of different heights.

BACKGROUND

Every day, companies around the world pack millions of items in cases (such as boxes formed from corrugated) to prepare them for shipping. Case sealers partially automate this process by applying pressure-sensitive tape to cases already packed with items and (in certain instances) protective dunnage to seal those cases shut. Random case sealers (a subset of case sealers) automatically adjust to the height of the case to-be-sealed so they can seal cases of different heights.

A typical random case sealer includes a frame including two lower drive belts and a lower tape cartridge; a mast mounted to the frame; and a top-head assembly movably mounted to the mast and including two upper drive belts, an upper tape cartridge, and a pressure switch. The lower tape cartridge is configured to apply tape to the leading, bottom, and trailing surfaces of the case as the upper and lower drive belts move the case past the lower tape cartridge, and the upper tape cartridge is configured to apply tape to the leading, upper, and trailing surfaces of the case as the upper and lower drive belts move the case past the upper tape cartridge.

In operation, an operator, such as a person or an automatic case-feeding system, moves a case into contact with the pressure switch. In response, an actuator begins raising the top-head assembly. Once the top-head assembly ascends above the case so the case stops contacting the pressure switch, the operator moves the case to a holding position beneath the top-head assembly. When the case is in the holding position, the bottom surface of the case rests on the lower drive belts. Since the lower drive belts continuously circulate, the operator must hold the case at the holding position (resisting the pull of the lower drive belts) as the top-head assembly descends. Once the upper drive belts contact the top surface of the case, the operator releases the case and the drive belts move the case relative to the tape cartridges, which apply tape to the case.

Holding the case at the holding position against the pull of the lower drive belts while waiting for the top-head assembly to descend can be an arduous task, particularly for heavy cases and in high-throughput applications. This can occasionally lead to operators releasing a case before the upper drive belt contacts the top surface of the case. This can throw off the timing of the case sealer (such as by triggering sensors that control various functions of the case sealer too early) and result in improper sealing and/or cause damage to the case or the product inside it. The same thing can occur if the operator accidentally pushes the case past the holding position.

SUMMARY

Various embodiments of the present disclosure provide a random case sealer including a case lifter configured to lift a case out of engagement with a lower drive element (such as a drive belt) of the case sealer as the case reaches a holding position beneath the top-head assembly and, afterwards, to lower the case into engagement with the lower drive element once the top-head assembly has descended to within a designated distance of the top surface of the case. In certain of these embodiments, the case lifter includes a case blocker positioned to stop the case from moving any further beneath the top-head assembly once it reaches the holding position.

Certain embodiments of the case sealer comprise: a frame; a lower drive element; a lower-drive-element actuator operably connected to and configured to drive the lower drive element; and a case lifter movable relative to the lower drive element between a case-lifting position in which a portion of the case lifter is above a top surface of the lower drive element and a retracted position in which the portion of the case lifter is not above the top surface of the lower drive element. When the case lifter is in the case-lifting position, the portion of the case lifter is oriented to lift part of a case above and out of contact with the lower drive element as the case is moved onto the case lifter.

Certain embodiments of a method of operating the case sealer to apply tape to a case comprise: driving a lower drive element of the case sealer; detecting the case adjacent a top-head assembly of the case sealer; responsive to detecting the case adjacent the top-head assembly, raising the top-head assembly above a top surface of the case; after part of the case has been moved onto a case lifter that is beneath the top-head assembly and that holds that part of the case above and out of contact with the lower drive element, automatically moving the case lifter to lower that part of the case into contact with the lower drive element once the case is within a designated distance of the top-head assembly; engaging the case with the top-head assembly; and moving the case past a tape cartridge of the case sealer via the lower drive element to apply tape to the case.

DETAILED DESCRIPTION

Figure 1:
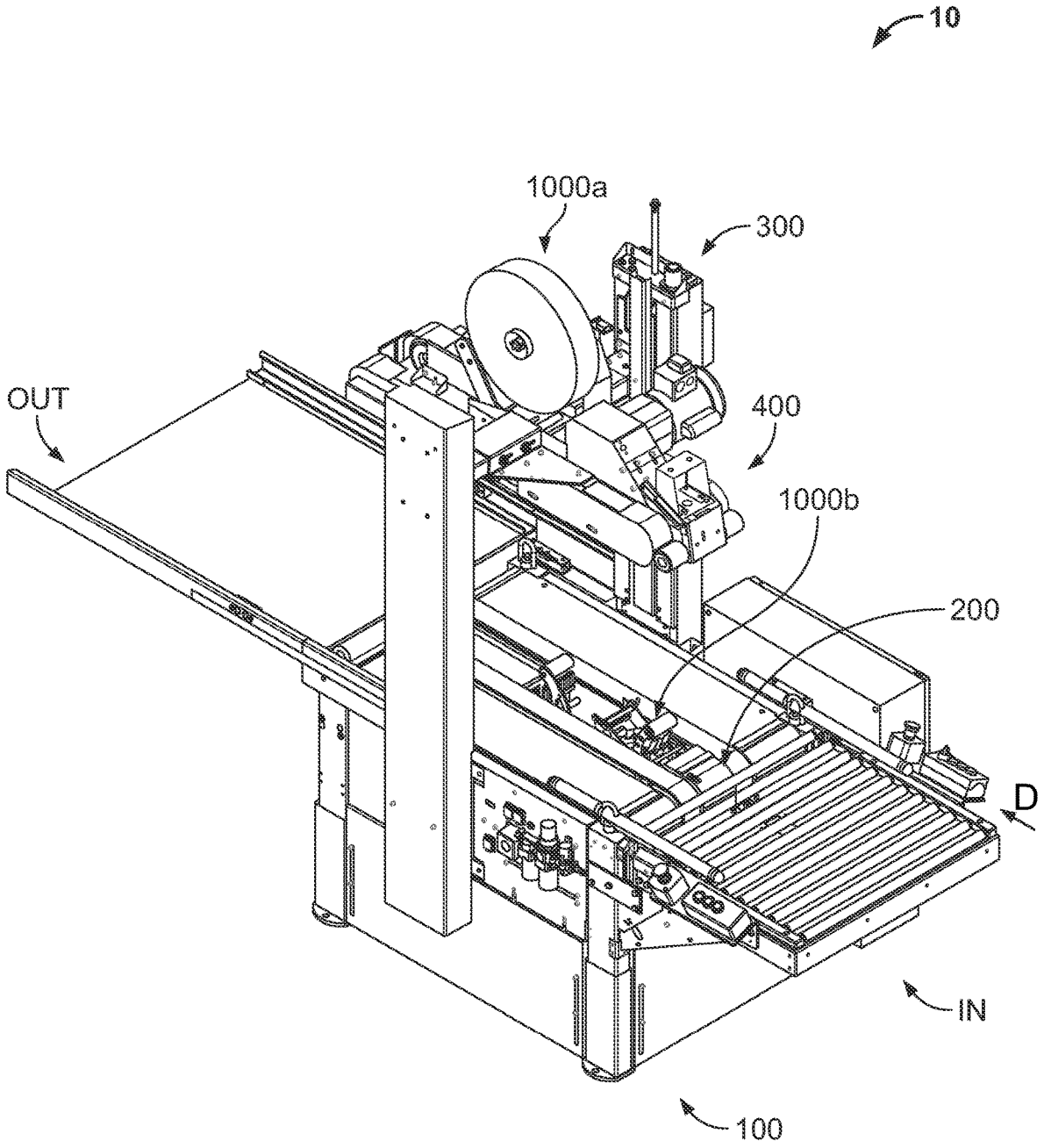
FIG. 1 is a perspective view of one example embodiment of a case sealer of the present disclosure.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connection of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as coupled, mounted, connected, etc., are not intended to be limited to direct mounting methods, but should be interpreted broadly to include indirect and operably coupled, mounted, connected, and like mounting methods. This specification is intended to be taken as a whole and interpreted in accordance with the principles of the present disclosure and as understood by one of ordinary skill in the art.

Various embodiments of the present disclosure provide a random case sealer including a case lifter configured to lift a case out of engagement with a lower drive element (such as a drive belt) of the case sealer as the case reaches a holding position beneath the top-head assembly and, afterwards, to lower the case into engagement with the lower drive element once the top-head assembly has descended to within a designated distance of the top surface of the case. In certain of these embodiments, the case lifter includes a case blocker positioned to stop the case from moving any further beneath the top-head assembly once it reaches the holding position.

Figure 2:
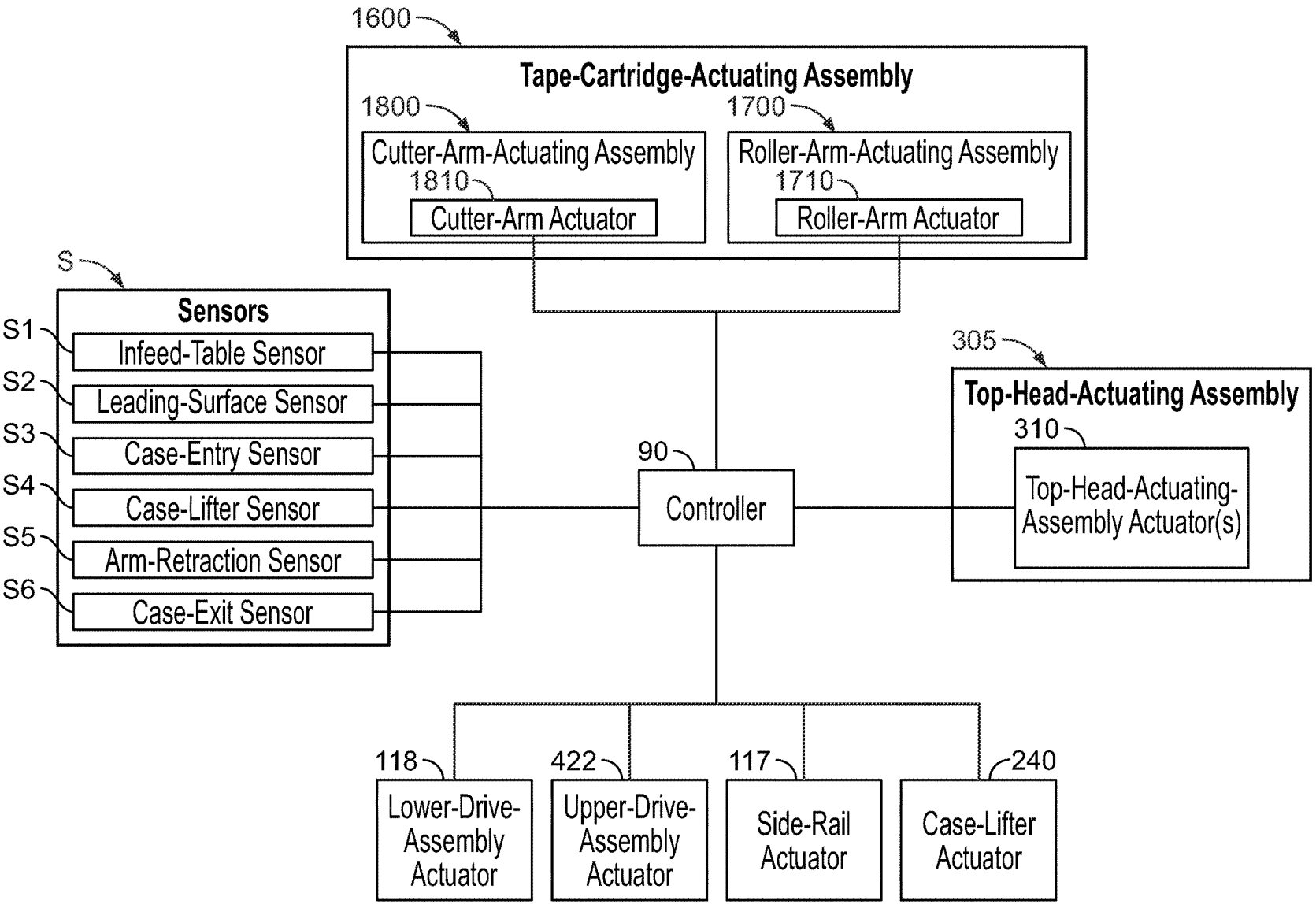
FIG. 2 is a block diagram showing certain components of the case sealer of FIG. 1.

FIG. 1 shows one example embodiment of a case sealer 10 of the present disclosure. The case sealer 10 includes a base assembly 100 including a case-lifting assembly 200, a mast assembly 300, a top-head assembly 400, an upper tape cartridge 1000*a*, and a lower tape cartridge 1000*b*. As shown in FIG. 2, the case sealer 10 also includes several actuating assemblies and actuators configured to control movement of certain components of the case sealer 10; multiple sensors S; and control circuitry and systems for controlling the actuating assemblies and the actuators (and other mechanical, electro-mechanical, and electrical components of the case sealer 10) responsive to signals received from the sensors S.

The case sealer 10 includes a controller 90 communicatively connected to the sensors S to send and receive signals to and from the sensors S. The controller 90 is operably connected to the actuating assemblies and the actuators to control the actuating assemblies and the actuators. The controller 90 may be any suitable type of controller (such as a programmable logic controller) that includes any suitable processing device(s) (such as a microprocessor, a microcontroller-based platform, an integrated circuit, or an application-specific integrated circuit) and any suitable memory device(s) (such as random access memory, read-only memory, or flash memory). The memory device(s) stores instructions executable by the processing device(s) to control operation of the case sealer 10.

Figure 3:
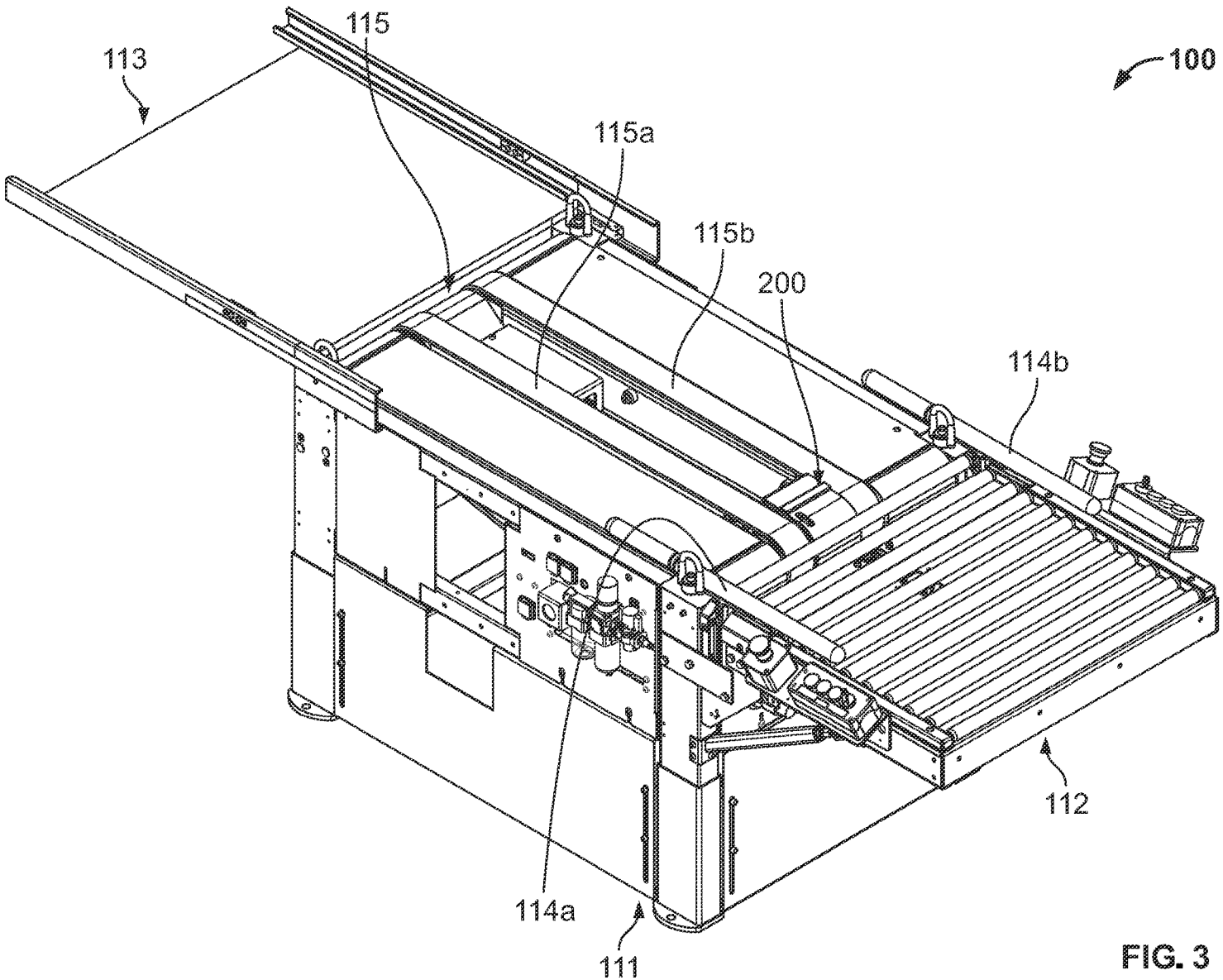
FIG. 3 is a perspective view of the base assembly of the case sealer of FIG. 1.

The base assembly 100 is configured to align cases in preparation for sealing, to support the lower tape cartridge 1000*b*, and to (along with the top-head assembly 400) move the cases through the case sealer 10. The base assembly 100 supports the mast assembly 300 (which supports the top-head assembly 400). As best shown in FIG. 3, the base assembly 100 includes a base-assembly frame 111, an infeed table 112, an outfeed table 113, a side-rail assembly (not labeled), a lower drive assembly 115, and a case-lifting assembly 200. The base assembly 100 defines an infeed end IN (FIG. 1) of the case sealer 10 at which an operator (such as a person or an automated case-feeding system) feeds cases to-be-sealed into the case sealer 10 (via the infeed table 112) and an outfeed end OUT (FIG. 1) of the case sealer 10 at which the case sealer 10 ejects sealed cases onto the outfeed table 113.

The base-assembly frame 111 is formed from any suitable combination of solid and/or tubular members and/or plates fastened together. The base-assembly frame 111 is configured to support the other components of the base assembly 100.

The infeed table 112 is mounted to the base-assembly frame 111 adjacent the infeed end IN of the case sealer 10. The infeed table 112 includes multiple rollers on which the operator can place and fill a case and then use to convey the filled case toward the top-head assembly 400. The infeed table 112 includes an infeed-table sensor S1 (FIG. 2), which may be any suitable sensor (such as a photoelectric sensor) configured to detect the presence of a case on the infeed table 112 (and, more particularly, the presence of a case at a particular location on the infeed table 112 that corresponds to the location of the infeed-table sensor S1). In other embodiments, another component of the case sealer 10 includes the infeed-table sensor S1. The infeed-table sensor S1 is communicatively connected to the controller 90 to send signals to the controller 90 responsive to detecting a case (a case-detected signal) and, afterwards, no longer detecting the case (a case-undetected signal), as described below.

The outfeed table 113 is mounted to the base-assembly frame 111 adjacent the outfeed end OUT of the case sealer 10. The outfeed table 113 includes a generally planar surface onto which the case is ejected after taping, though it may include multiple rollers in other embodiments.

The side-rail assembly is supported by the base-assembly frame 111 adjacent the infeed table 112 and includes first and second side rails 114*a* and 114*b* and a side-rail actuator 117 (FIG. 2). The side rails 114*a* and 114*b* extend generally parallel to a direction of travel D (FIG. 1) of a case through the case sealer 10 and are movable laterally inward (relative to the direction of travel D) to laterally center the case on the infeed table 112. The side-rail actuator 117 is operably connected to the first and second side rails 114*a* and 114*b* (either directly or via suitable linkages) to move the side rails between: (1) a rest configuration (FIG. 1) in which the side rails are positioned at or near the lateral extents of the infeed table 112 to enable an operator to position a case to-be-sealed between the side rails on the infeed table 112; and (2) a centering configuration (not shown) in which the side rails (after being moved toward one another) contact the case and center the case on the infeed table 112. The controller 90 is operably connected to the side-rail actuator 117 to control the side-rail actuator 117 to move the side rails 114*a* and 114*b* between the rest and centering configurations. The side-rail actuator 117 may be any suitable type of actuator, such as a motor or a pneumatic cylinder fed with pressurized gas and controlled by one or more valves.

The lower drive assembly 115 is supported by the base-assembly frame 111 and (along with a top-drive assembly 420, described below) configured to move cases in the direction D. The lower drive assembly 115 includes a first and second lower drive elements 116*a* and 116*b* (though it may include only one drive element or more than two drive elements in other embodiments) and a lower-drive-assembly actuator 118 (FIG. 2) operably connected to the first and second lower drive elements 116*a* and 116*b* to drive the first and second lower drive elements to (along with the top-drive assembly 420) move cases through the case sealer 10. In this example embodiment, the lower-drive-assembly actuator 118 includes a motor that is operably connected to the first and second lower drive elements 116*a* and 116*b*-which include endless belts in this example embodiment-via one or more other components, such as sprockets, gearing, screws, tensioning elements, and/or a chain. The lower-drive-assembly actuator 118 may include any other suitable actuator in other embodiments. The first and second lower drive elements 116*a* and 116*b* may include any other suitable component or components, such as rollers, in other embodiments. The controller 90 is operably connected to the lower-drive-assembly actuator 118 to control operation of the lower-drive-assembly actuator 118.

The lower drive assembly 115 supports a case-entry sensor S3 downstream of the infeed table 112 and the leading-surface sensor S2 (described below) and beneath the top-head assembly 400 so the case-entry sensor S3 can detect when a case enters the space below the top-head assembly 400. As used herein, "downstream" means in the direction of travel D, and "upstream" means the direction opposite the direction of travel D. Also, unless explicitly stated otherwise, "above" and "below" as used herein mean "in a plane above" and "in a plane below" and not "directly above" or "directly below." case-entry sensor S3 includes a proximity sensor (or any other suitable sensor, such as a mechanical sensor) configured to detect the presence of a case. In other embodiments, the case-entry sensor S3 is supported by the mast assembly 300 or the top-head assembly 400. The case-entry sensor S3 is communicatively connected to the controller 90 to send signals to the controller 90 responsive to detecting the case (a case-detected signal) and no longer detecting the case (a case-undetected signal).

The base-assembly frame 111 supports a case-exit sensor S6 that includes a proximity sensor (or any other suitable sensor) configured to detect the presence of a case. Here, although not shown, the case-exit sensor S6 is positioned near the outfeed table 113 (downstream of the case-entry and retraction sensors S3 and S4 described below) so the case-exit sensor S6 can detect when a case exits from beneath the top-head assembly 400. The case-exit sensor S6 is communicatively connected to the controller 90 to send signals to the controller 90 responsive to detecting the case (a case-detected signal) and no longer detecting the case (a case-undetected signal). In other embodiments, the case-exit sensor S6 is part of the top-head assembly 400.

Figure 4A:
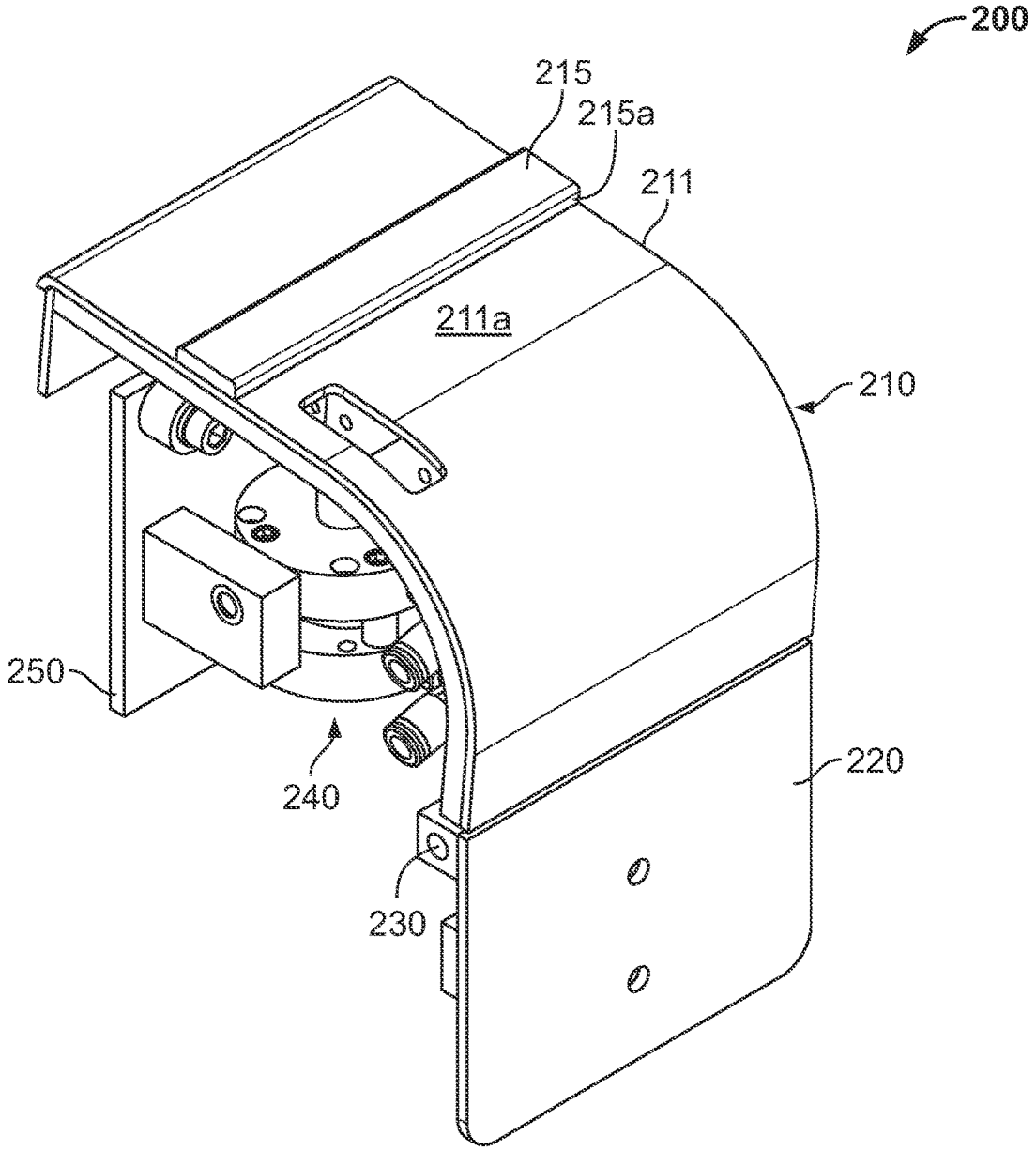
FIGS. 4A and 4B are perspective views of the case-lifting assembly of the case sealer of FIG. 1.
Figure 4B:
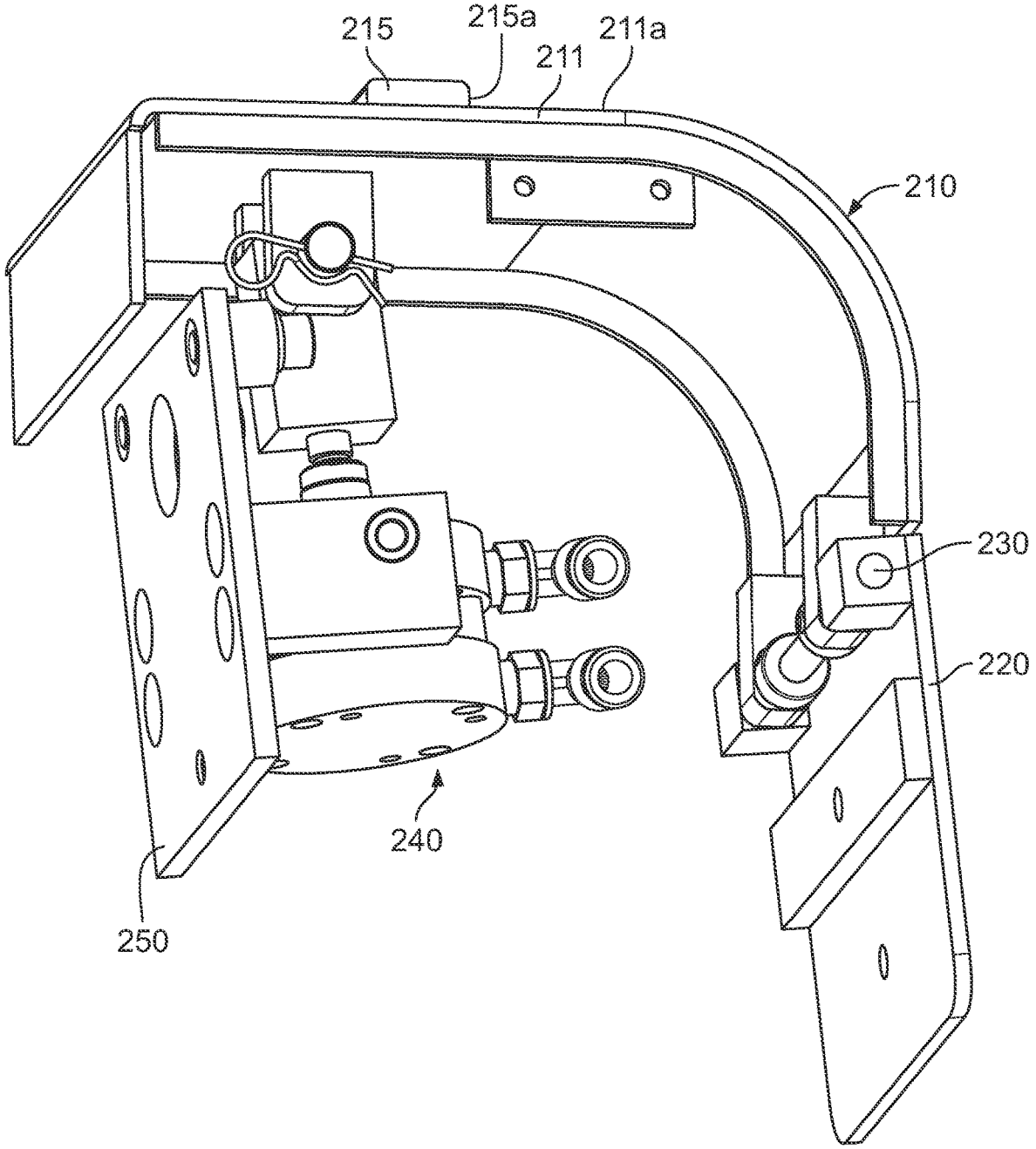

The case-lifting assembly 200 is mounted to the base-assembly frame 111 and configured to lift cases out of engagement with the lower drive elements 116*a* and 116*b* as the cases reach a holding position beneath the top-head assembly 400 and, afterwards, to lower the cases into engagement with the lower drive elements 116*a* and 116*b* once the top-head assembly 400 has descended to within a designated distance of the top surface of the cases. In this example embodiment, the case-lifting assembly 200 is also configured to stop the cases from moving any further beneath the top-head assembly 400 once the cases reach the holding position. As best shown in FIGS. 4A and 4B, the case-lifting assembly 200 includes case lifter 210, a case-lifter mounting plate 220, a case-lifter mounting pin 230, a case-lifter actuator 240, and a case-lifter-actuator mounting plate 250.

The case lifter 210 includes a body 211 including a generally planar case-engaging surface 211*a* and a case blocker 215 extending from the case-engaging surface 211*a*. The case blocker 215 includes a case-engaging surface 215*a* oriented to face cases as they travel toward the case lifter 210 in the direction D. In this example embodiment the body is L-shaped, though it may have any other suitable shape in other embodiments. The case-lifter mounting plate 220 is attached to the base-assembly frame 111, such as via suitable fasteners, between the first and second lower drive elements 116*a* and 116*b*. The case lifter 210 is pivotably mounted to the case-lifter mounting plate 220 via the case-lifter mounting pin 230 (such as by inserting the case-lifter mounting pin through mounting bores defined through the case lifter 210 and the case-lifter mounting plate 220). The case-lifter actuator 240 is attached to the case-lifter-actuator mounting plate 250, such as via suitable fasteners. The case-lifter-actuator mounting plate 250 is attached to the base-assembly frame 111, such as via suitable fasteners, between the first and second lower drive elements 116*a* and 116*b*.

Figure 5A:
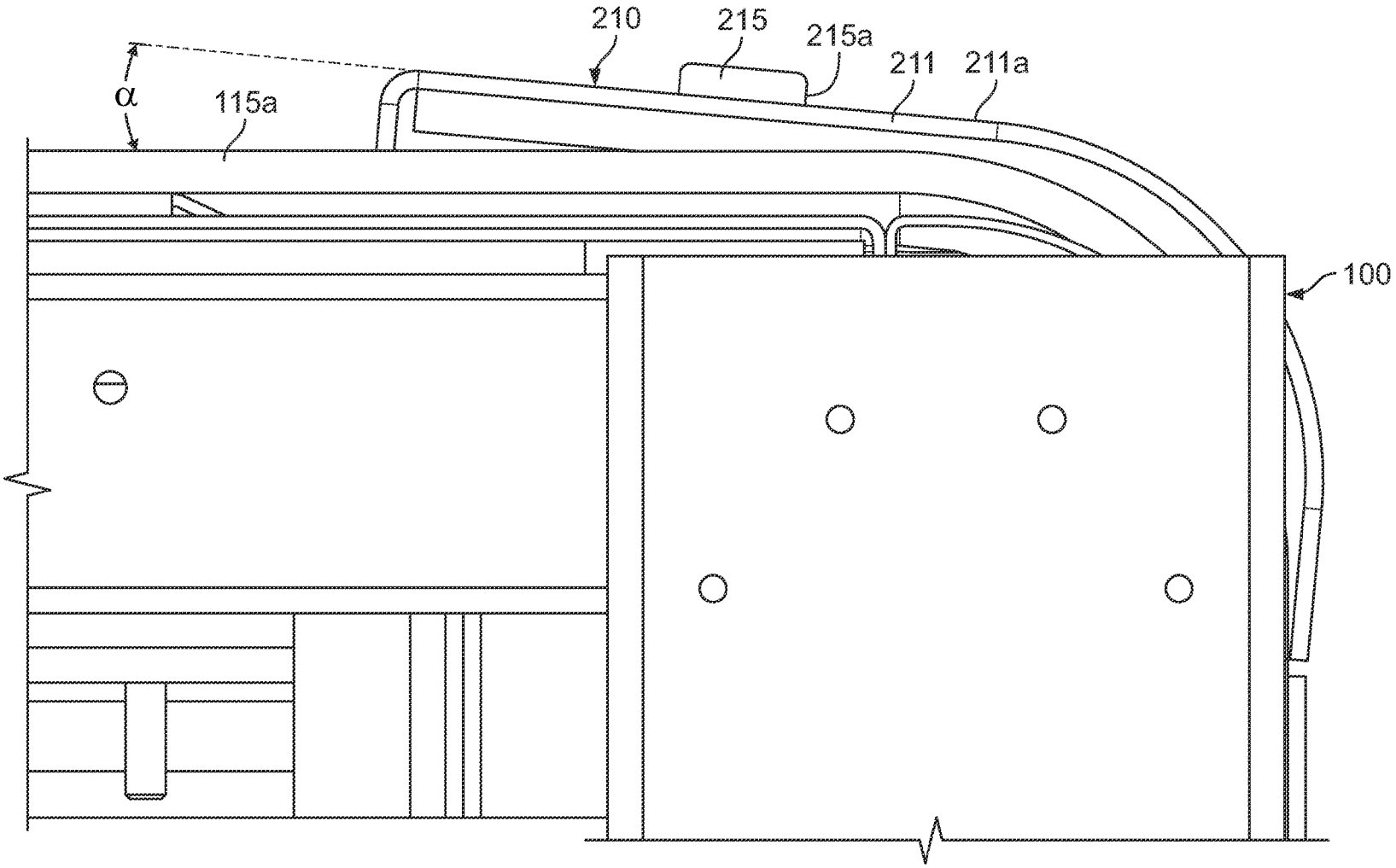
FIGS. 5A and 5B are side views of part of the case sealer of FIG. 1 with the case lifter in its case-lifting and retracted positions, respectively.
Figure 5B:
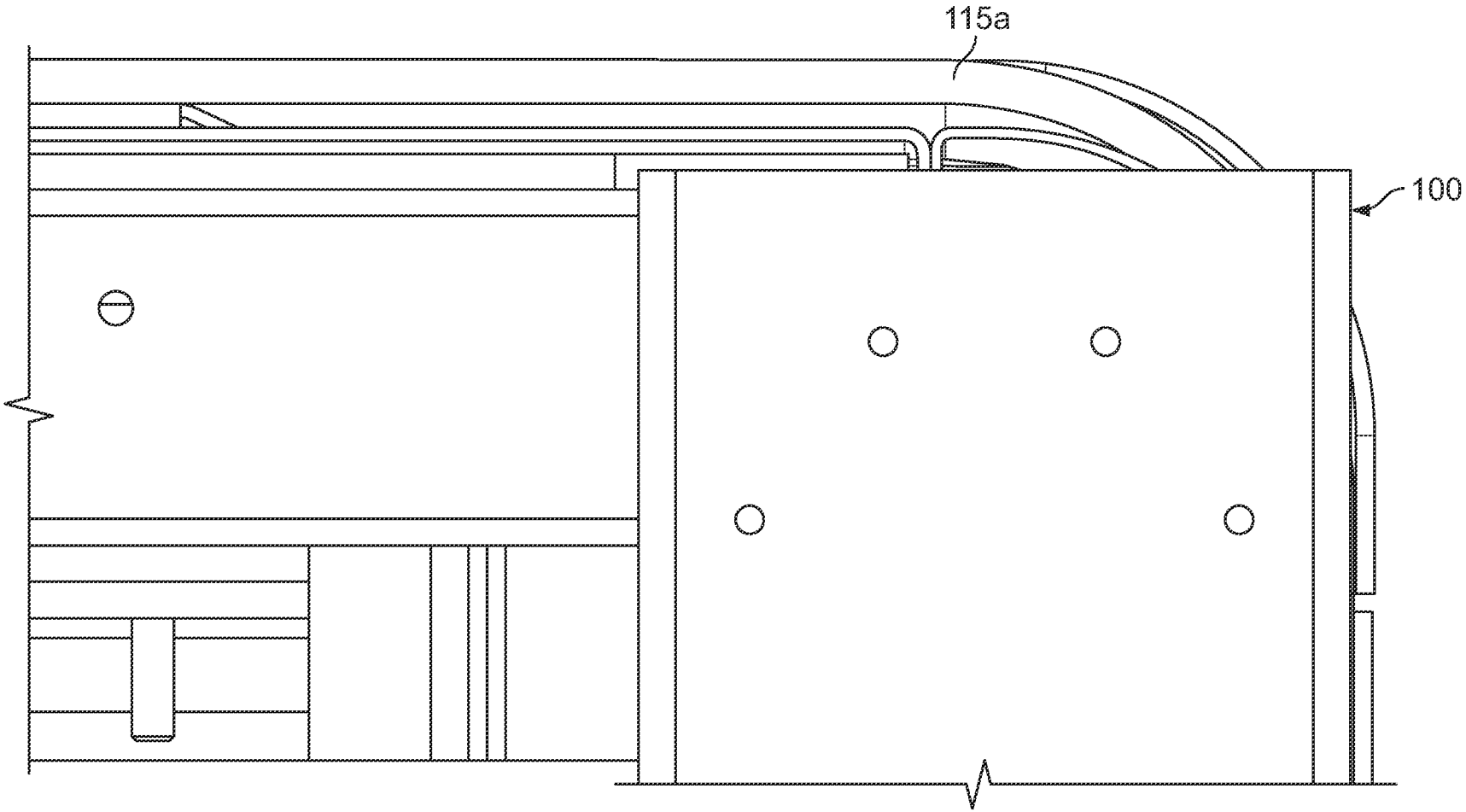

The case-lifter actuator 240 is operably connected to the case lifter 210 to pivot the case lifter 210 about the case-lifter mounting pin 230 and relative to the lower drive assembly 115 between a case-lifting position (FIG. 5A) and a retracted position (FIG. 5B). The case-lifter actuator 240 includes a pneumatic actuator in this example embodiment, but may be any other suitable actuator (such as a motor or a hydraulic actuator) in other embodiments. In this example embodiment, the case lifter 210 pivots away from the cases (counterclockwise with respect to the viewpoint shown in FIGS. 5A and 5B) when pivoting from its case-lifting position to its retracted position (and vice-versa).

The controller 90 is operably connected to the case-lifter actuator 240 to control movement of the case lifter 210 between its case-lifting and retracted positions. That is, in this example embodiment, the case-lifter actuator 240 actively moves the case lifter 210 from its case-lifting position to its retracted position and vice-versa. In other embodiments, the case-lifter actuator is configured to actively move the case lifter either from its case-lifting position to its retracted position or vice-versa. In these embodiments, the case lifter is biased by a suitable biasing element (such as a spring) to the other one of the case-lifting and retracted positions. In these embodiments, the case-lifter actuator is configured to move the case lifter to its non-biased position against the biasing force of the biasing element.

As best shown in FIG. 5A, when the case lifter 210 is in its case-lifting position, the case lifter 210 is oriented so at least part of the case-engaging surface 211*a* of the body 211 and at least part of the case-engaging surface 215*a* of the case blocker 215 are positioned above the upper surfaces of the first and second lower drive elements 116*a* and 116*b*. As a case is pushed in the direction D, the body 211 gradually lifts the case above and out of engagement with the first and second lower drive elements 116*a* and 116*b*. The case blocker 215 stops the case from moving further beneath the top-head assembly 400 when the case engages the case-engaging surface 215*a*. At this point the case is in the holding position. Accordingly, this example embodiment of the case lifter 210—when in the case-lifting position—stops the case from being pushed past the holding position while maintaining the case out of contact with the first and second lower drive elements 116*a* and 116*b*.

In this example embodiment, when in the case-lifting position, the case lifter 210 is oriented so a nonzero angle $\alpha$, which here is about 9 degrees but may be any other suitable nonzero angle in other embodiments, is formed between the case-engaging surface 211*a* and the top surface of the first and second lower drive elements 116*a* and 116*b* (which are substantially horizontal in this example embodiment). This means that the case-engaging surface 211*a* effectively forms a ramp when the case lifter 210 is in its case-lifting position. As best shown in FIG. 5B, when the case lifter 210 is in its retracted position, the case-engaging surface 211*a* and the case blocker 215 are positioned such that they are not above (and in this example embodiment are below) the upper surfaces of the first and second lower drive elements 116*a* and 116*b* to enable the first and second lower drive elements to engage and move the case in the direction D.

The mast assembly 300 is configured to support and control vertical movement of the top-head assembly 400 relative to the base assembly 100. The mast assembly 300 includes a top-head-actuating assembly 305 that includes one or more top-head-actuating-assembly actuators 310 (FIG. 2) operably connected to the top-head assembly 400 and configured to move the top-head assembly 400 toward and away from the base assembly 100. In this example embodiment, the top-head-assembly actuator includes a pneumatic cylinder fed with pressurized gas and controlled by one or more valves, though it may be any other suitable type of actuator (such as a motor) in other embodiments. The controller 90 is operably connected to the top-head-assembly actuator(s) to control vertical movement of the top-head assembly 400.

Figure 6:
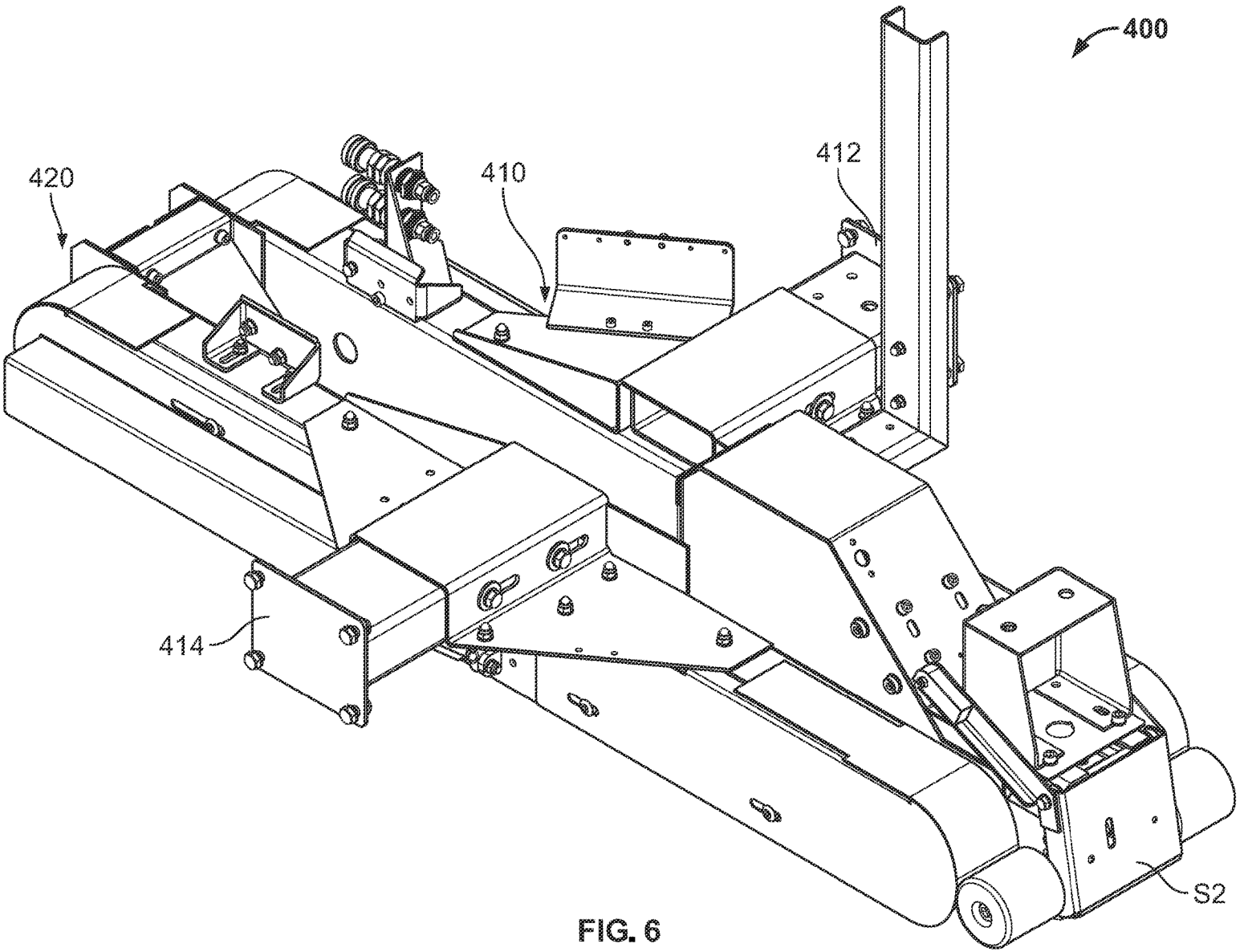
FIG. 6 is a perspective view of the top-head assembly of the case sealer of FIG. 1.

The top-head assembly 400 is movably supported by the mast assembly 300 to adjust to cases of different heights and is configured to move the cases through the case sealer 10, engage the top surfaces of the cases while doing so, and support the upper tape cartridge 1000*a*. As best shown in FIGS. 2 and 6, the top-head assembly 400 includes a top-head-assembly frame 410, an upper drive assembly 420, a leading-surface sensor S2, a case-lifter sensor S4, an arm-retraction sensor S5, and a case-exit sensor S6. In other embodiments, one or more other components of the case sealer 10 (such as the base assembly 100 and/or the mast assembly 300) include the one or more of the sensors S2, S4, S5, and S6.

The top-head-assembly frame 410 is configured to mount the top-head assembly 400 to the mast assembly 300 and to support the other components of the top-head assembly 400, and is formed from any suitable combination of solid or tubular members and/or plates fastened together. The top-head-assembly frame 410 includes laterally extending first and second mounting arms 412 and 414 to which the top-head-assembly actuator 310 of the mast assembly 300 is operatively connected.

The upper drive assembly 420 is supported by the top-head-assembly frame 410 and (along with the lower drive assembly 115, described above) configured to move cases in the direction D. The upper drive assembly 420 includes an upper drive element (or in other embodiments multiple upper drive elements) and an upper-drive-assembly actuator 422 (FIG. 2) operably connected to the upper drive element to drive the upper drive element to (along with the lower drive assembly 115) move cases through the case sealer 10. In this example embodiment, the upper-drive-assembly actuator 422 includes a motor that is operably connected to the upper drive element-which includes an endless belt in this example embodiment-via one or more other components, such as sprockets, gearing, screws, tensioning elements, and/or a chain. The upper-drive-assembly actuator 422 may include any other suitable actuator in other embodiments. The upper drive element may include any other suitable component or components, such as rollers, in other embodiments. The controller 90 is operably connected to the upper-drive-assembly actuator 422 to control operation of the upper-drive-assembly actuator 422.

The leading-surface sensor S2 includes a mechanical paddle switch (or any other suitable sensor, such as a proximity sensor) positioned at a front end of the top-head-assembly frame 410 and configured to detect when the leading surface of a case initially contacts (or is within a predetermined distance of) the top-head assembly 400. The leading-surface sensor S2 is communicatively connected to the controller 90 to send signals to the controller 90 responsive to actuation (a case-detected signal) and de-actuation (a case-undetected signal) of the leading-surface sensor S2 (corresponding to the leading-surface sensor S2 detecting and no longer detecting the case and/or an object).

The case-lifter sensor S4 includes a proximity sensor (or any other suitable sensor) configured to detect the presence of a case (and in particular, detect a case within a designated distance of the proximity sensor). Here, although not shown, the case-lifter sensor S4 is positioned on the underside of the top-head-assembly frame 410 so the case-lifter sensor S4 can detect when a case reaches a particular position underneath the top-head assembly 400 (here, the holding position). The case-lifter sensor S4 is communicatively connected to the controller 90 to send signals to the controller 90 responsive to detecting the case (a case-detected signal) and no longer detecting the case (a case-undetected signal).

The retraction sensor S5 includes a proximity sensor (or any other suitable sensor) configured to detect the presence of a case. Here, although not shown, the retraction sensor S5 is positioned on the underside of the top-head-assembly frame 410 downstream of the case-entry sensor S3 so the retraction sensor S5 can detect when a case reaches a particular position underneath the top-head assembly 400 (here, a position just before the case contacts the front roller, as explained below). The retraction sensor S5 is communicatively connected to the controller 90 to send signals to the controller 90 responsive to detecting the case (a case-detected signal) and no longer detecting the case (a case-undetected signal).

The controller 90 is operably connected to: (1) the top-head-actuating assembly 305 and configured to control the top-head-actuating assembly 305 to control vertical movement of the top-head assembly 400 responsive to signals received from the sensors S2, S3, and S5; and (2) the upper tape cartridge 1000*a* and the lower tape cartridge 1000*b* and configured to control the force-reduction functionality of these tape cartridges responsive to signals received from the sensor S4, as described in detail below in conjunction with FIG. 8.

Figure 7A:
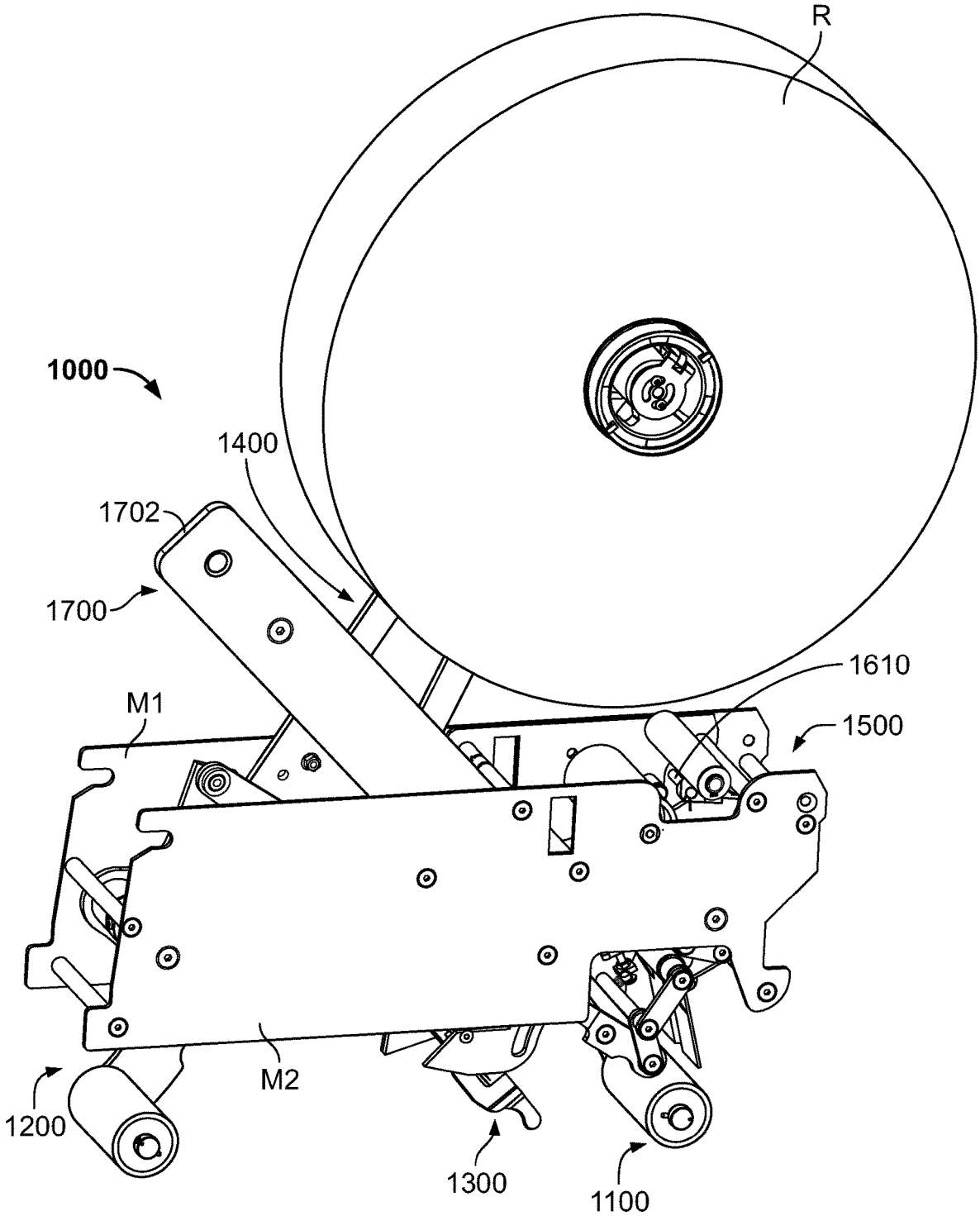
FIGS. 7A-7H are various views of the tape cartridge (and components thereof) of the case sealer of FIG. 1.
Figure 7B:
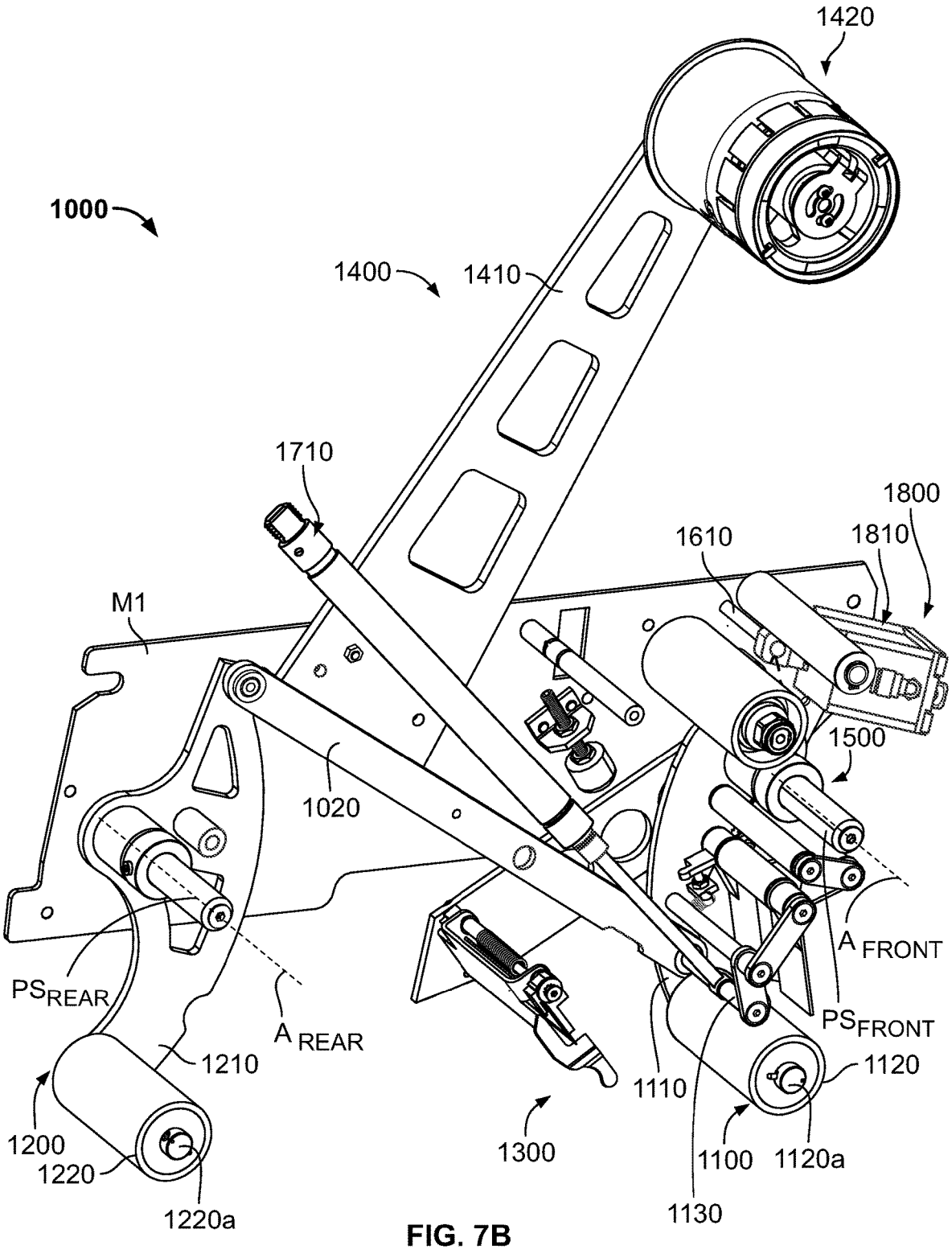
Figure 7C:
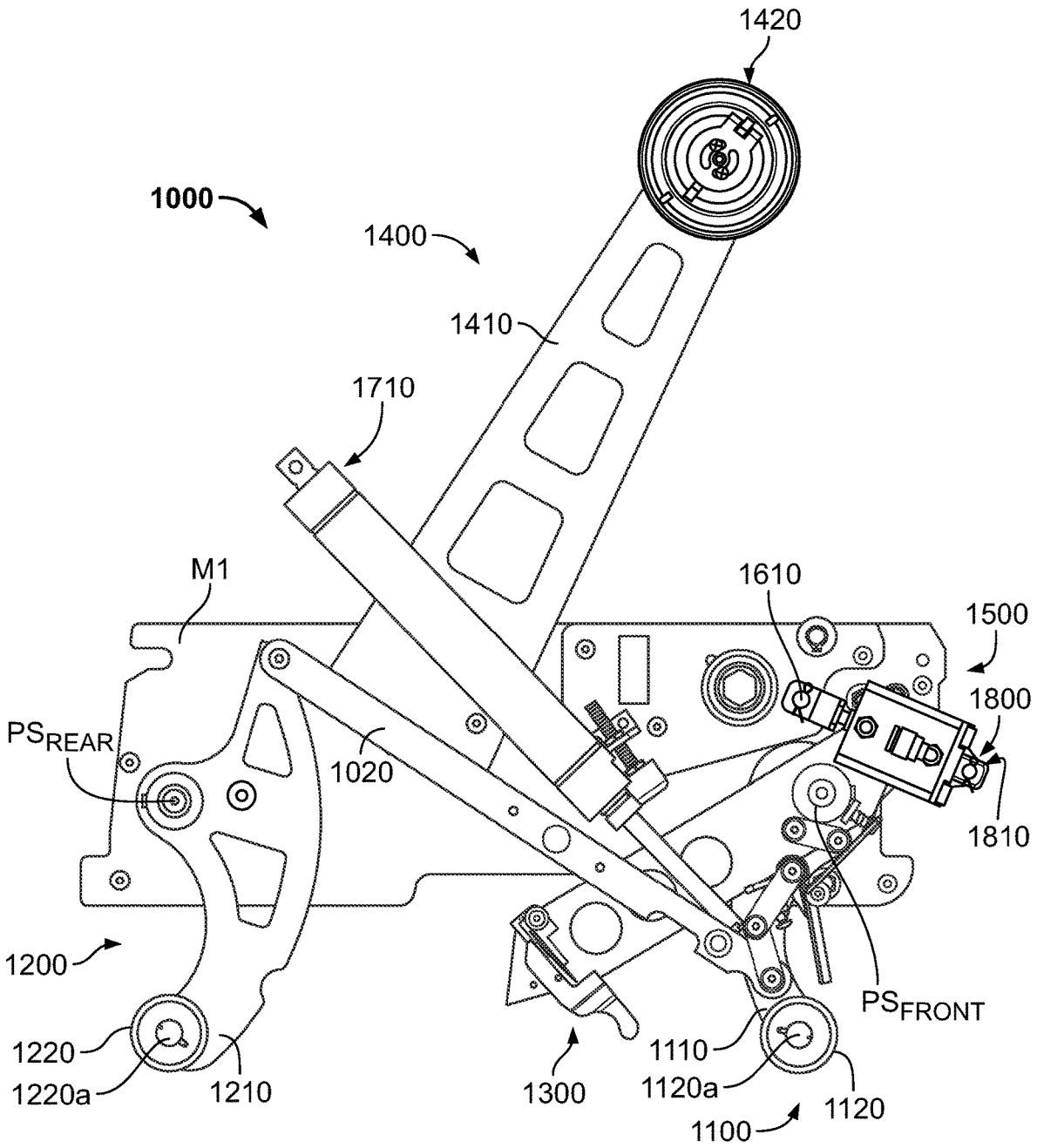

The upper tape cartridge 1000*a* is removably mounted to the top head assembly 400 and configured to apply tape to a leading surface, a top surface, and a trailing surface of a case. Although not separately described, the lower tape cartridge 1000*b* is removably mounted to the base assembly 100 and configured to apply tape to the leading surface, the bottom surface, and the trailing surface of the case. As best shown in FIGS. 2 and 7A-7H, the tape cartridge 1000 includes a first mounting plate M1 that supports a front roller assembly 1100, a rear roller assembly 1200, a cutter assembly 1300, a tape-mounting assembly 1400, a tension-roller assembly 1500, and a tape-cartridge-actuating assembly 1600. As best shown in FIG. 7A, a second mounting plate M2 is mounted to the first mounting plate M1 via multiple spacer shafts and fasteners (not labeled) to partially enclose certain elements of the front roller assembly 1100, the rear roller assembly 1200, the cutter assembly 1300, the tape-mounting assembly 1400, the tension-roller assembly 1500, and the tape-cartridge-actuating assembly 1600 therebetween.

Figure 7D:
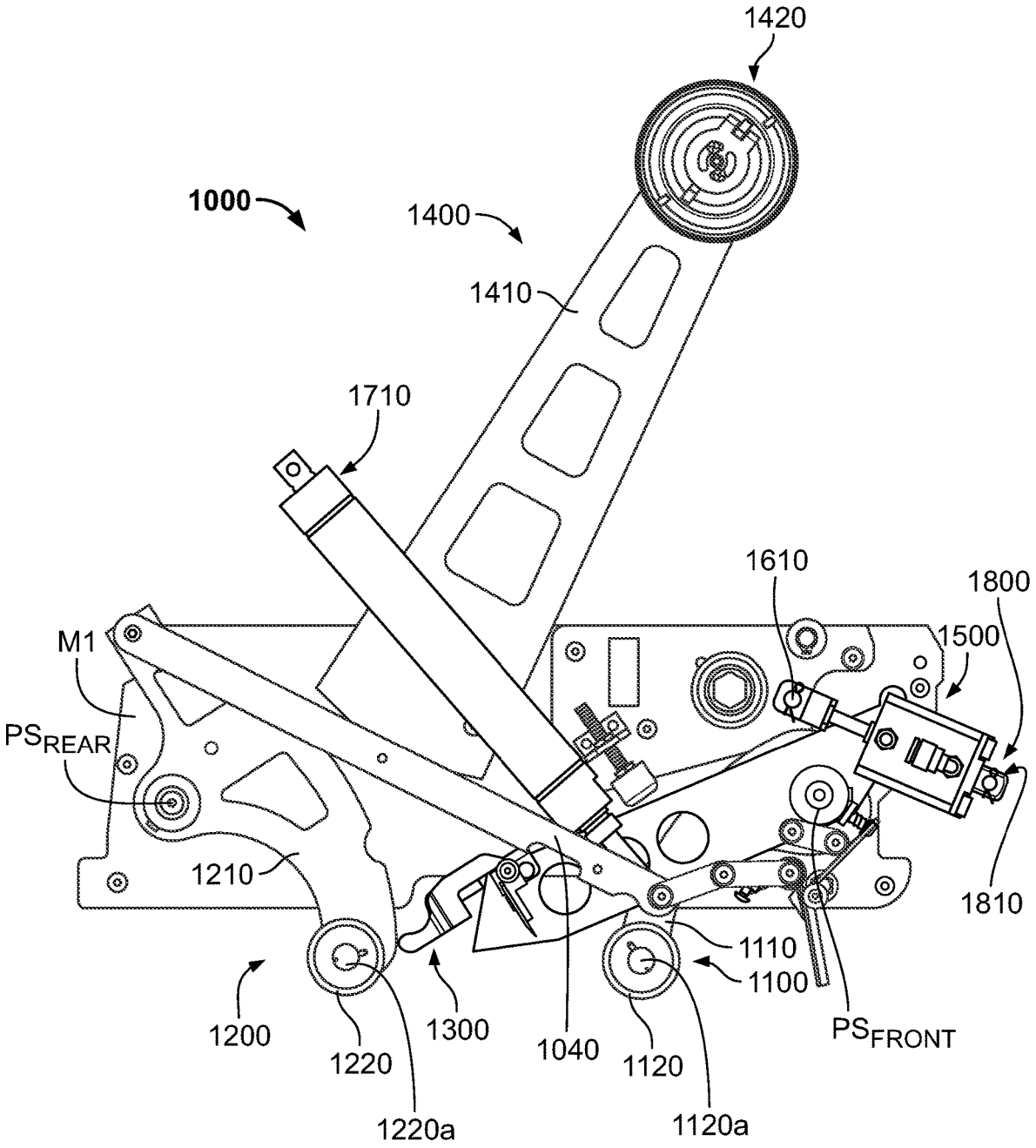

The front roller assembly 1100 includes a front roller arm 1110 and a front roller 1120. The front roller arm 1110 is pivotably mounted to the first mounting plate M1 via a front roller-arm-pivot shaft $PSE_{RONT}$ so the front roller arm 1110 can pivot relative to the mounting plate M1 about an axis $A_{FRONT}$ between a front roller arm extended position (FIGS. 7A-7C) and a front roller arm retracted position (FIG. 7D). The front roller arm 1110 includes a front roller-mounting shaft 1120*a*, and the front roller 1120 is rotatably mounted to the front roller-mounting shaft 1120*a* so the front roller 1120 can rotate relative to the front roller-mounting shaft 1120*a*.

The rear roller assembly 1200 includes a rear roller arm 1210 and a rear roller 1220. The rear roller arm 1210 is pivotably mounted to the first mounting plate M1 via a rear roller-arm-pivot shaft $PS_{REAR}$ so the rear roller arm 1210 can pivot relative to the mounting plate M1 about an axis $A_{REAR}$ between a rear roller arm extended position (FIGS. 7A-7C) and a rear roller arm retracted position (FIG. 7D). The rear roller arm 1210 includes a rear roller-mounting shaft 1220*a*, and the rear roller 1220 is rotatably mounted to the rear roller-mounting shaft 1220*a* so the rear roller 1220 can rotate relative to the rear roller-mounting shaft 1220*a*.

A rigid first linking member 1020 is attached to and extends between the first roller arm 1110 and the second roller arm 1210. The first linking member 1020 links the front and rear roller assemblies 1100 and 1200 so: (1) moving the front roller arm 1110 from the front roller arm extended position to the front roller arm retracted position causes the first linking member 1020 to force the rear roller arm 1210 to move from the rear roller arm extended position to the rear roller arm retracted position (and vice-versa); and (2) moving the rear roller arm 1210 from the rear roller arm extended position to the rear roller arm retracted position causes the first linking member 1020 to force the front roller arm 1110 to move from the front roller arm extended position to the front roller arm retracted position (and vice-versa).

The tape-cartridge-actuating assembly 1600 (FIG. 2) includes a roller-arm-actuating assembly 1700 and a cutter-arm-actuating assembly 1800.

The roller-arm-actuating assembly 1700 is configured to move the linked front and rear roller arms 1110 and 1210 between their respective extended and retracted positions. As best shown in FIG. 7G, in this example embodiment the roller-arm-actuating assembly 1700 includes a support plate 1702 and a roller-arm actuator 1710 pivotably attached to the support plate 1702 via a pin assembly 1703. The roller-arm actuator 1710 may be any suitable actuator, such as a motor or a pneumatic cylinder fed with pressurized gas and controlled by one or more valves.

The roller-arm actuator 1710 is operably connected to the front roller assembly 1100 to control movement of the front roller arm 1110 and the rear roller arm 1210 linked to the front roller arm 1110 between their respective extended and retracted positions. More specifically, the roller-arm actuator 1710 is coupled between the mounting plate M2 and the first roller arm assembly 1100 via attachment of the support plate 1702 to the mounting plate M2 and attachment of the roller-arm actuator 1710 to the shaft 1130 of the front roller assembly 1100.

The controller 90 is operably connected to the roller-arm actuator 1710 and configured to control the roller-arm actuator 1710 and therefore the positions of the front and rear roller arms 1110 and 1210.

Figure 7E:
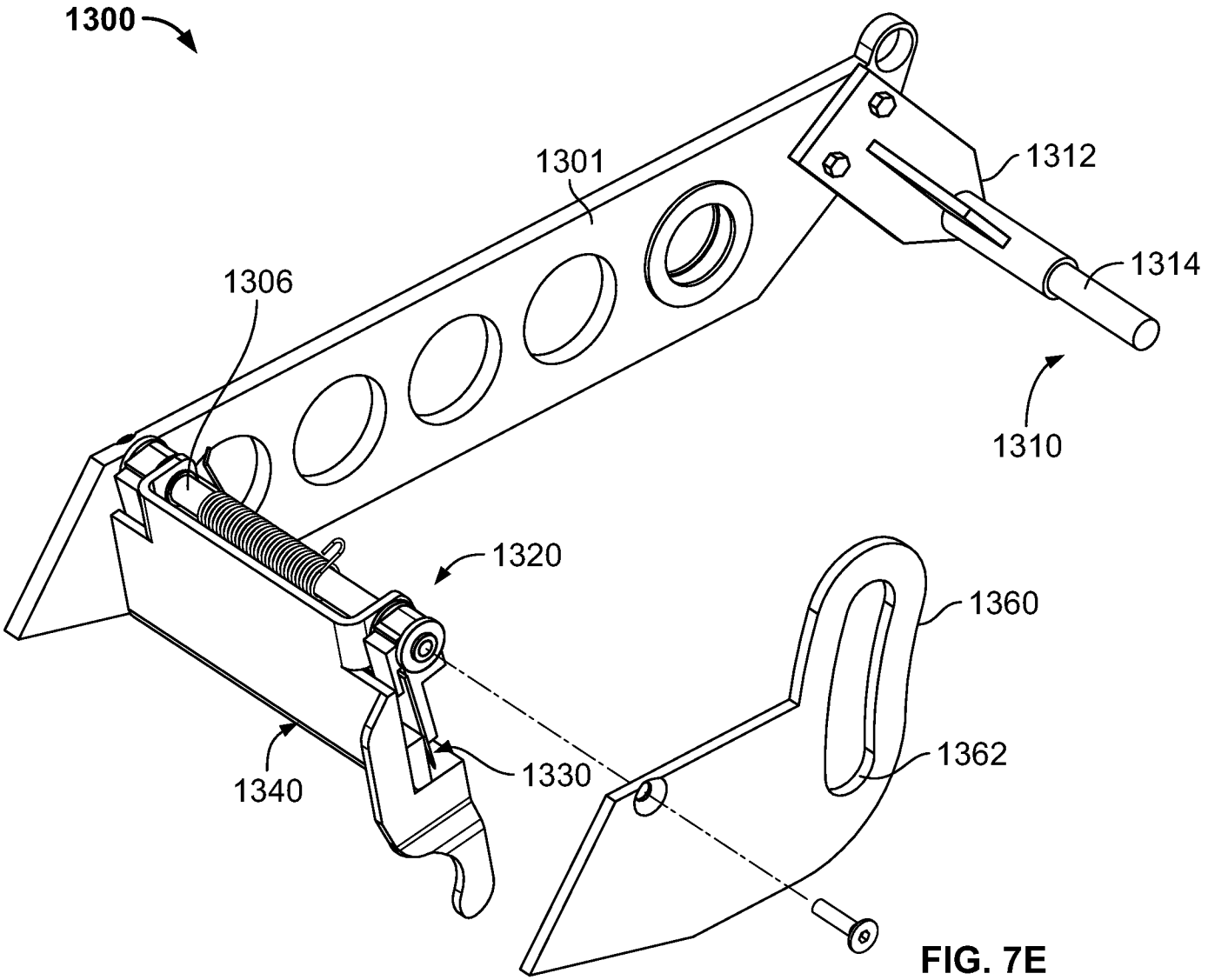
Figure 7F:
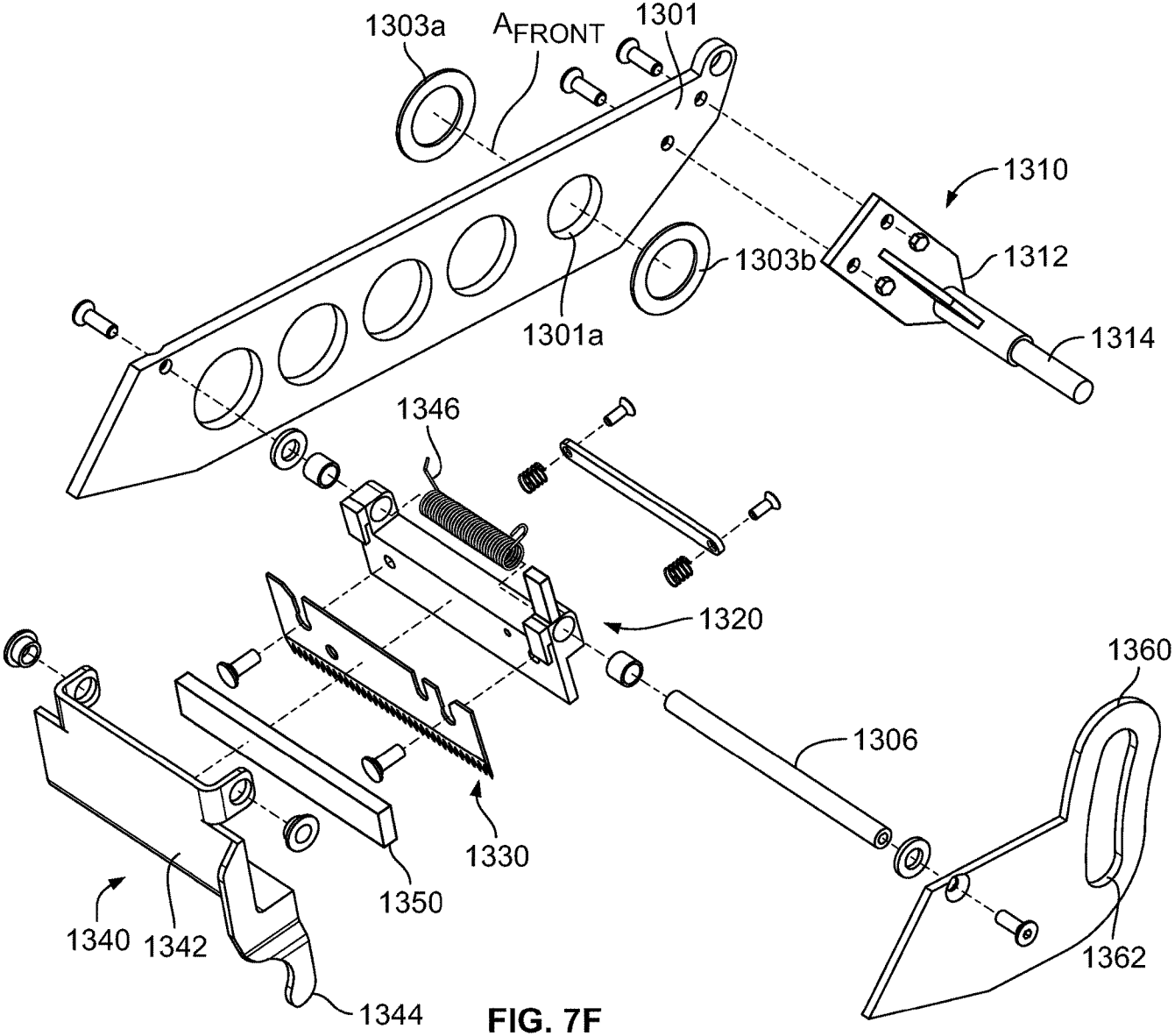

As best shown in FIGS. 7E and 7F, the cutter assembly 1300 includes a cutter arm 1301, a cutting-device cover pivot shaft 1306, a cutter-arm-actuator-coupling element 1310, a cutting-device-mounting assembly 1320, a cutting device 1330 including a toothed blade (not labeled) configured to sever tape, a cutting-device cover 1340, a cutting-device pad 1350, and a rotation-control plate 1360.

The cutter arm 1301 includes a cylindrical surface 1301*a* that defines a cutter arm mounting opening. The cutter arm 1301 is pivotably mounted (via the cutter arm mounting opening) to the first mounting plate M1 via the front roller-arm-pivot shaft $PS_{FRONT}$ and bushings 1303*a* and 1303*b* so the cutter arm 1301 can pivot relative to the mounting plate M1 about the axis $A_{FRONT}$ between a cutter arm extended position (FIGS. 7A-7C) and a cutter arm retracted position (FIG. 7D).

The cutter-arm-actuator-coupling element 1310 includes a support plate 1312 and a coupling shaft 1314 extending transversely from the support plate 1312. The support plate 1312 is fixedly attached to the cutter arm 1301 via fasteners 1316 so the coupling shaft 1314 is generally parallel to and coplanar with the axis $A_{FRONT}$.

The cutting-device-mounting assembly 1320 is fixedly mounted to the support arm 1310 (such as via welding) and is configured to removably receive the cutting device 1330. That is, the cutting-device-mounting assembly 1320 is configured so the cutting device can be removably mounted to the cutting-device-mounting assembly 1320. The cutting-device-mounting assembly 1320 is described in U.S. Pat. No. 8,079,395, though any other suitable cutting-device-mounting assembly may be used to support the cutting device 1330.

The cutting-device cover 1340 includes a body 1342 and a finger 1344 extending from the body 1342. A pad 1350 is attached to the body 1342. The cutting-device cover 1340 is pivotably mounted to the support arm 1310 via mounting openings (not labeled) and the cutting-device cover pivot shaft 1306. Once attached, the cutting-device cover 1340 is pivotable about the axis $A_{COVER}$ relative to the cutter arm 1301 and the cutting device mount 1320 from front to back and back to front between a closed position and an open position. A cutting-device cover biasing element 1346, which includes a torsion spring in this example embodiment, biases the cutting-device cover 1340 to the closed position. When in the closed position, the cutting-device cover 1340 generally encloses the cutting device 1330 so the pad 1350 contacts the toothed blade of the cutting device 1330. When in the open position, the cutting-device cover 1340 exposes the cutting device 1330 and its toothed blade.

The cutting-device cover pivot shaft 1306 is also attached to the rotation-control plate 1360. The rotation-control plate 1360 includes a slot-defining surface 1362 that defines a slot. The surface 1362 acts as a guide (not shown) for a bushing that is attached to the mounting plate M2. The bushing provides lateral support for the cutter assembly 1300 to generally prevent the cutter assembly from moving toward or away from the mounting plates M1 and M2 and interfering with other components of the tape cartridge 1000 when in use.

Figure 7H:
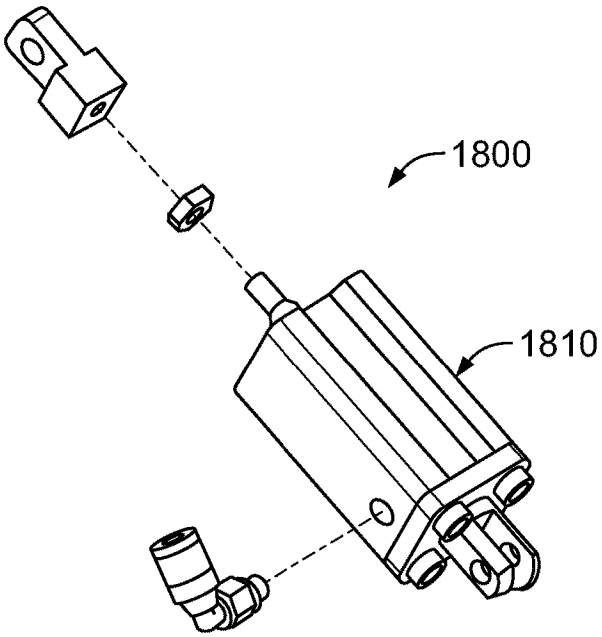
Figure 7G:
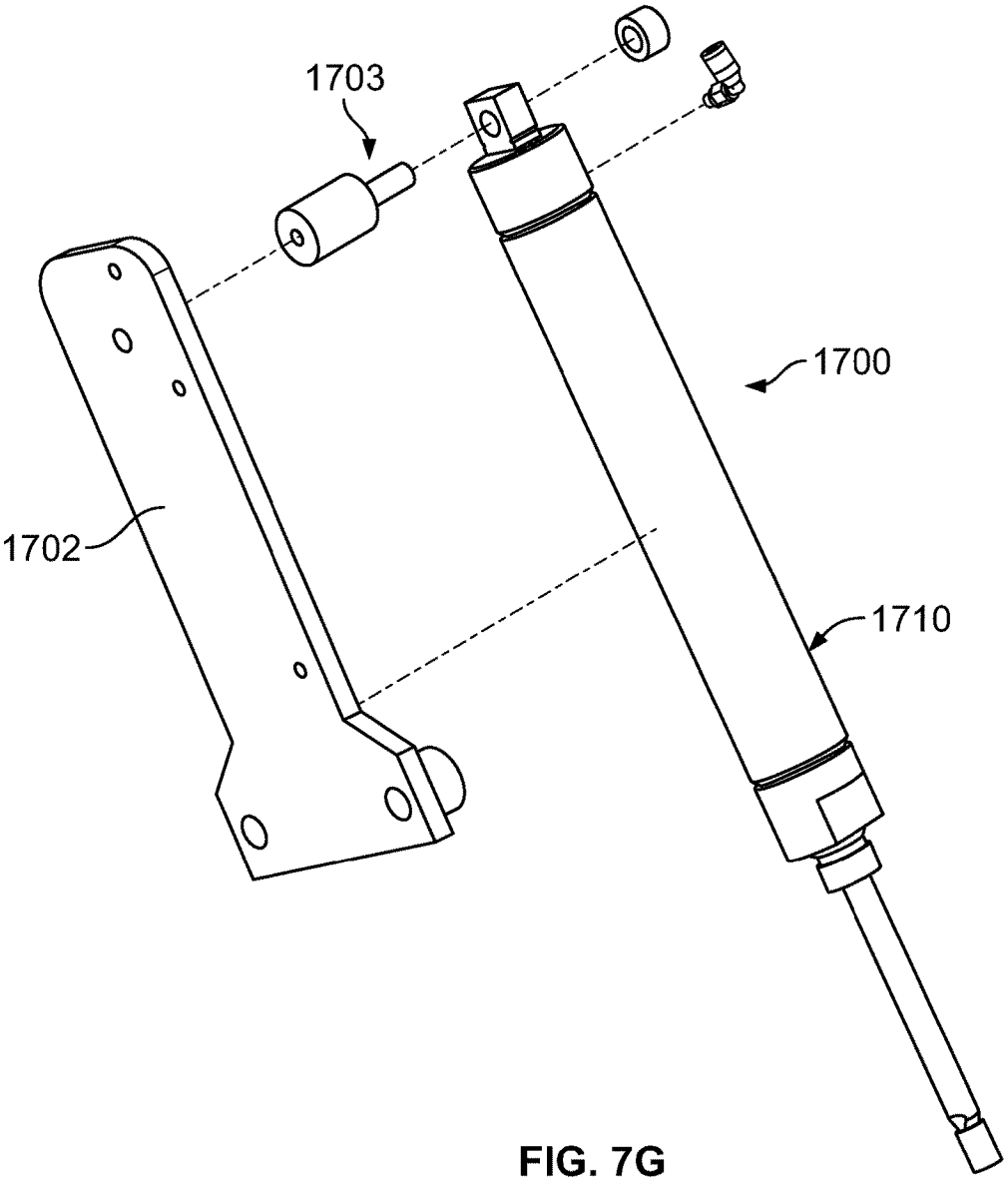

The cutter-arm-actuating assembly 1800 is configured to move the cutter arm 1301 between its retracted position and its extended position. As best shown in FIG. 7H, in this example embodiment the cutter-arm-actuating assembly 1800 includes a cutter-arm actuator 1810. The cutter-arm actuator 1810 may be any suitable actuator, such as a motor or a pneumatic cylinder fed with pressurized gas and controlled by one or more valves.

The cutter-arm actuator 1810 is operably connected to the cutter assembly 1300 to control movement of the cutter arm 1301 from its retracted position to its extended position. More specifically, the cutter-arm actuator 1810 is coupled between the mounting plate M1 and the cutter assembly 1300 via attachment to the shaft 1610 and to the coupling shaft 1314 of the cutter-arm-actuator-coupling element 1310.

The controller 90 is operably connected to the cutter-arm actuator 1810 and configured to control the cutter-arm actuator 1810 and therefore the positions of the cutter arm 1110 and 1301.

The tape-mounting assembly 1400 includes a tape-mounting plate 1410 and a tape-core-mounting assembly 1420 rotatably mounted to the tape-mounting plate 1410. The tape-core-mounting assembly 1420 is further described in U.S. Pat. No. 7,819,357, the entire contents of which are incorporated herein by reference (though other tape core mounting assemblies may be used in other embodiments). A roll R of tape is mountable to the tape-core-mounting assembly 1420.

The tension-roller assembly 1500 includes several rollers (not labeled) rotatably disposed on shafts that are supported by the first mounting plate M1. A free end of the roll R of tape mounted to the tape-core-mounting assembly 1420 is threadable through the rollers until the free end is adjacent the front roller 1120 of the front-roller assembly 1110 with its adhesive side facing outward in preparation for adhesion to a case. The tension-roller assembly 1500 is further described in U.S. Pat. No. 7,937,905 (though other tension roller assemblies may be used in other embodiments).

Figure 8:
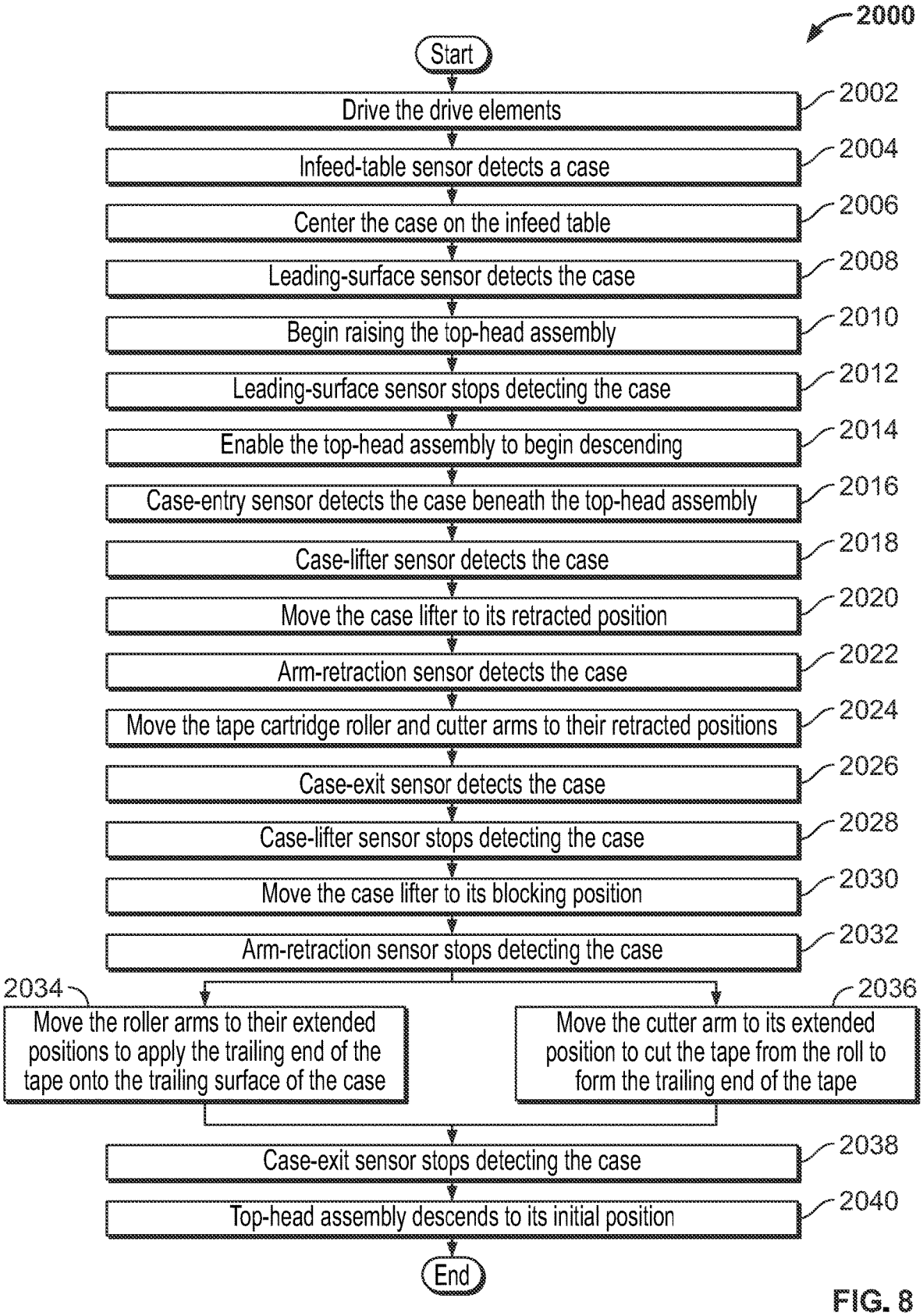
FIG. 8 is a flowchart showing one example case-sealing process.

Operation of the case sealer 10 to seal a case C is now described with reference to the flowchart shown in FIG. 8, which shows a case-sealing process 2000, and FIGS. 8A-9D, which show the case sealer 10 during the early stages of the case-sealing process 2000. The operator is a person in this example embodiment.

Figure 9A:
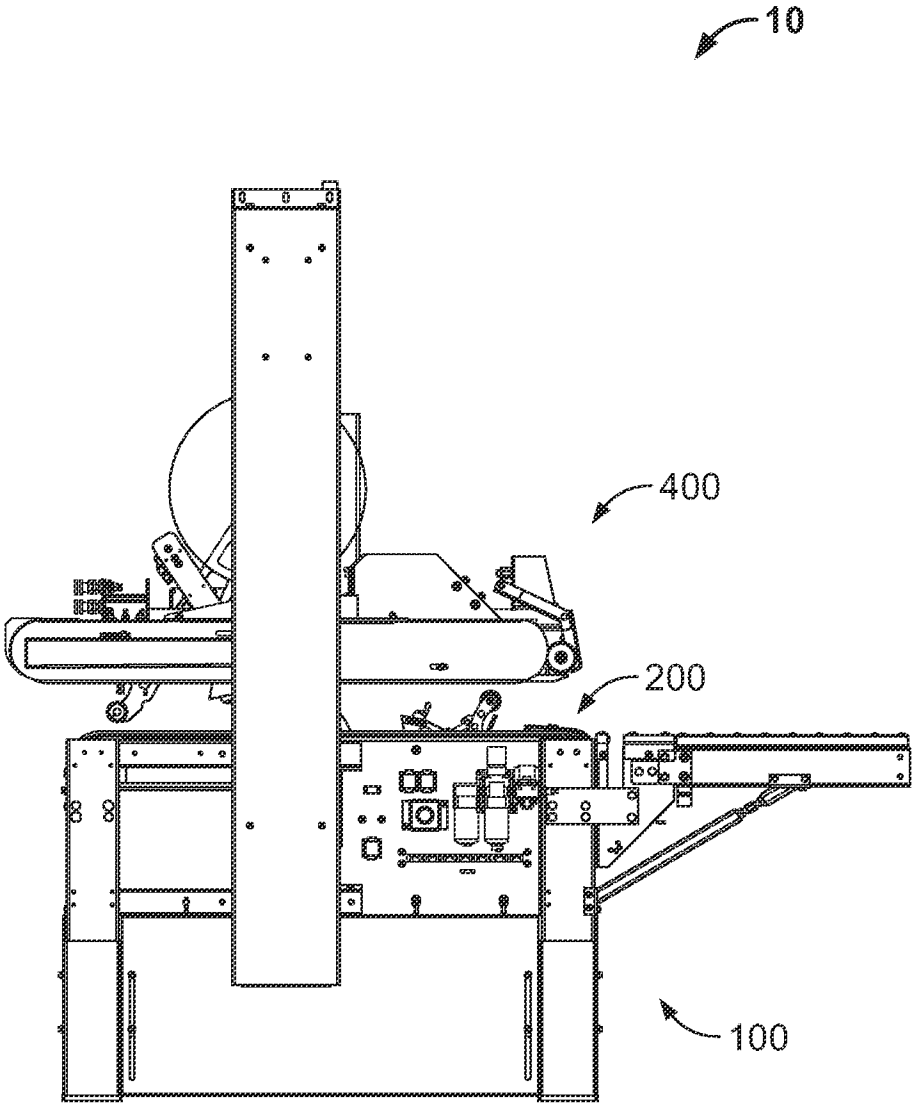
FIGS. 9A-9D are side views of the case sealer of FIG. 1 during the early stages of the case-sealing process of FIG. 7.

Initially, and as shown in FIG. 9A, the top-head assembly 400 is at its initial (lower) position, the side rails 114*a* and 114*b* are in their rest configuration, and the case lifter 210 is in its case-lifting position. The controller 90 controls the lower-drive-assembly actuator 118 and the upper-drive-assembly actuator 422 to drive the first and second lower drive elements 116*a* and 116*b* of the base assembly 100 and the upper drive element of the top-head assembly 400, respectively, as block 2002 indicates.

The operator positions the case C onto the infeed table 112. The infeed-table sensor S1 detects the presence of the case C, as block 2004 indicates, and in response sends a corresponding case-detected signal to the controller 90. Responsive to receiving that case-detected signal, the controller 90 controls the side-rail actuator 117 to move the side rails 114*a* and 114*b* from the rest configuration to the centering configuration so the side rails 114*a* and 114*b* move laterally inward to engage and center the case C on the infeed table 112, as block 2006 indicates.

Figure 9B:
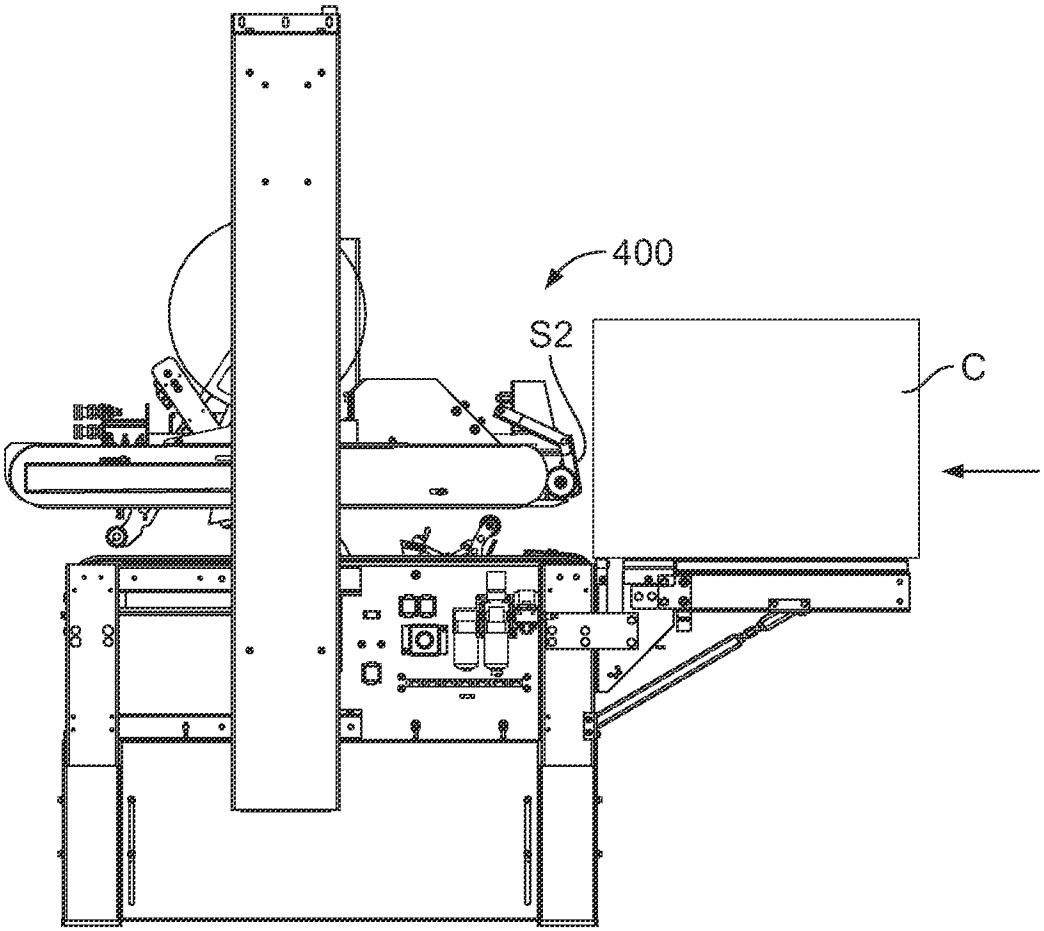

The operator then moves the case C into contact with the leading-surface sensor S2, as shown in FIG. 9B. This causes the leading-surface sensor S2 (via the case C contacting and actuating the paddle switch of the leading-surface sensor S2) to detect the case C, as block 2008 indicates, and in response send a corresponding case-detected signal to the controller 90. Responsive to receiving the case-detected signal, the controller 90 controls the top-head-actuating assembly 305 (and, more particularly, the top-head-actuating-assembly actuator(s) 310) to begin raising the top-head assembly 400, as block 2010 indicates.

As the top-head assembly 300 moves upward, the leading-surface sensor S2 eventually stops detecting the case C, as block 2012 indicates and as shown in FIG. 8C. This indicates that the top-head assembly 400 has ascended above the top surface of the case C. In response to no longer detecting the case C, the leading-surface sensor S2 sends a corresponding case-undetected signal to the controller 90. Responsive to receiving that signal, the controller 90 controls the top-head-actuating assembly 305 (and more particularly the top-head-actuating-assembly actuator(s) 310) to enable the top-head assembly 400 to stop its ascent and begin descending, as block 2014 indicates.

Figure 9C:
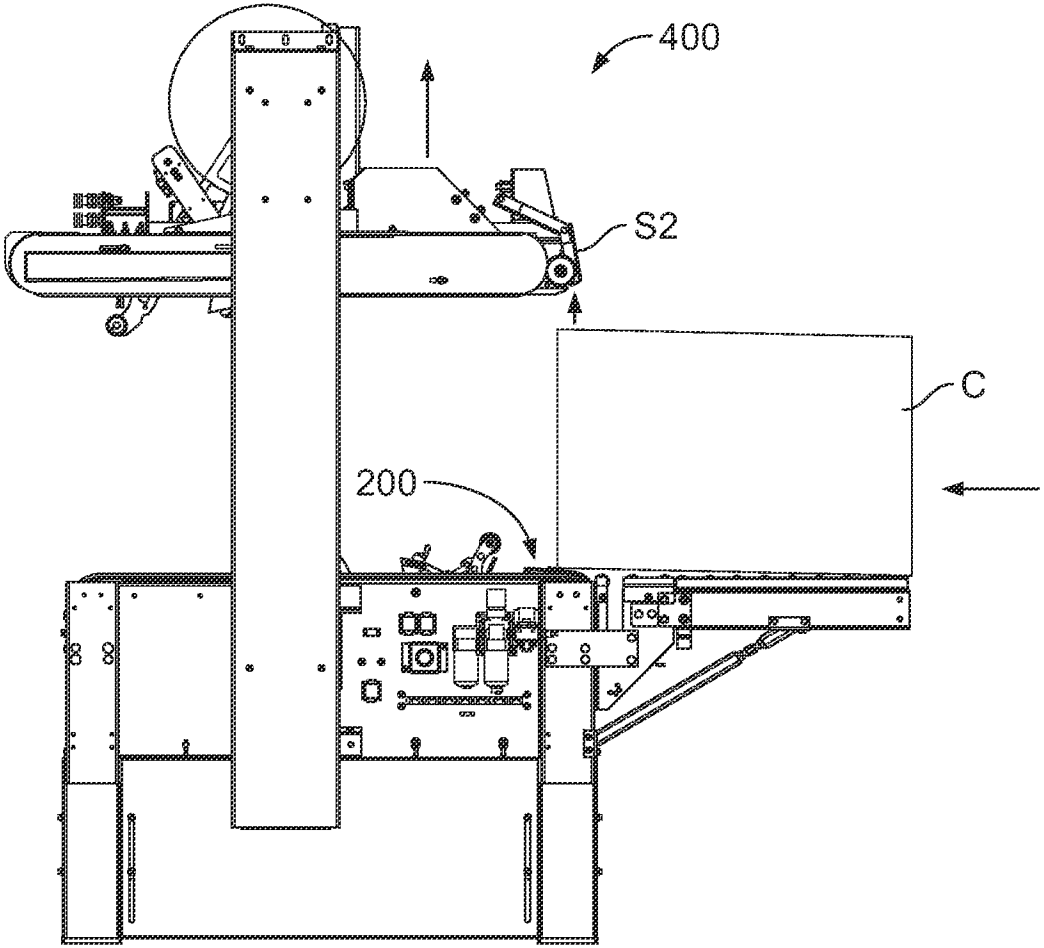

Once the top-head assembly 400 ascends above the top surface of the case C, the operator moves the case C beneath the top-head assembly 300. As the operator does so, the case C engages and moves along the case-engaging surface 211*a* of the body 211 of the case lifter 210 toward the case blocker 215 of the case lifter 210. Since the case-engaging surface 211*a* is inclined relative to the first and second lower drive elements 116*a* and 116*b*, it forms a ramp that lifts the lower surface of the case C above and out of contact with the first and second lower drive elements 116*a* and 116*b*. The case C eventually engages the case-engaging surface 215*a* of the case blocker 215, thereby reaching the holding position, at which point the operator stops moving the case C since the case blocker 215 prevents further movement in the direction D. FIG. 9C shows the case C at the holding position.

Figure 9D:
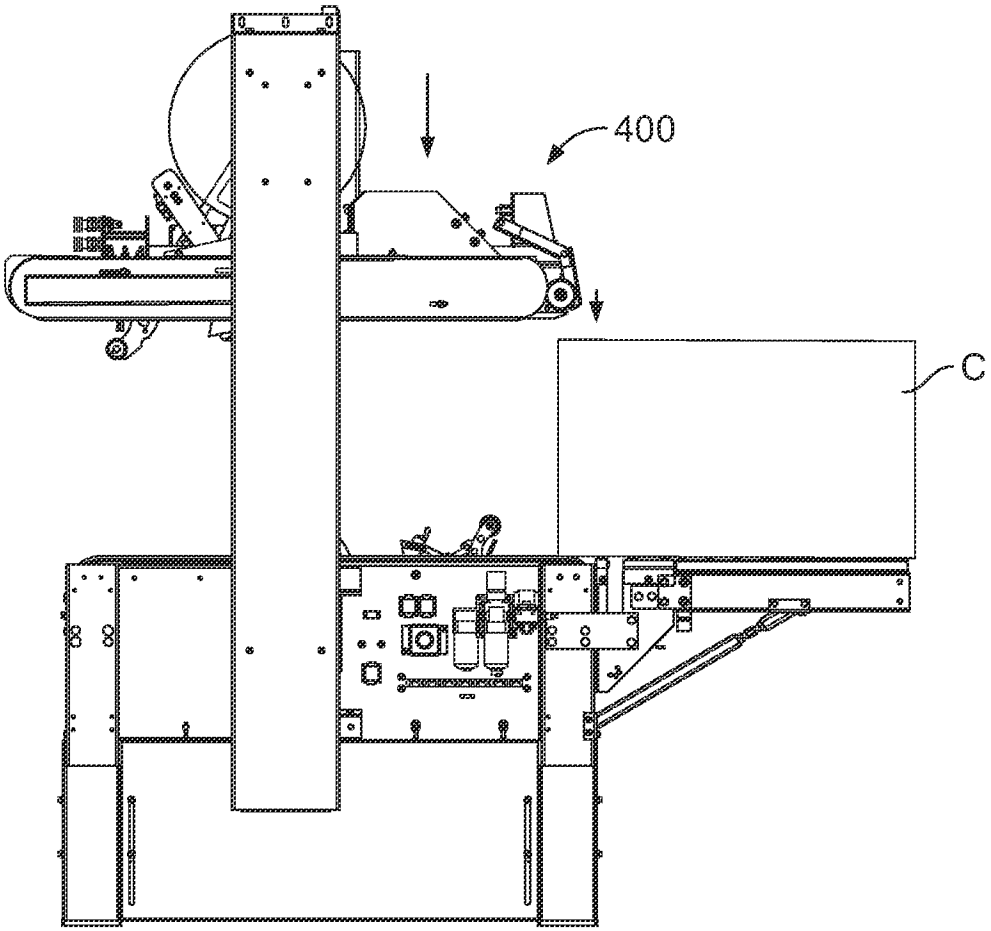

As the case C moves beneath the top-head assembly 400 and toward the holding position, the case-entry sensor S3 detects the presence of the case C beneath the top-head assembly and in response sends a corresponding case-detected signal to the controller 90, as block 2016 indicates. Responsive to receiving that case-detected signal, the controller 90 begins monitoring for a case-detected signal from the case-lifter sensor S4 as the top-head assembly 400 continues to descend. Eventually, the case-lifter sensor S4 detects the presence of the case C and in response sends a case-detected signal to the controller 90, as block 2018 indicates. Responsive to receiving that case-detected signal, the controller 90 controls the case-lifter actuator 240 to move the case lifter 210 from its case-lifting position to its retracted position, as block 2020 indicates. As this occurs, the case C is lowered onto the first and second lower drive elements 116*a* and 116*b*, as shown in FIG. 9D, which begin moving the case C in the direction D. Shortly thereafter (or at the same time as or shortly before, depending on the embodiment), the upper drive element of the upper drive assembly of the top-head assembly 400 engages the top surface of the case and joins the first and second lower drive elements in moving the case C in the direction D.

The controller 90 receives a case-detected signal from the arm-retraction sensor S5 (indicating that the arm-retraction sensor S5 detected the case C) and in response controls the roller-arm actuator 1710 and the cutter-arm actuator 1810 to move the first and second roller arms 1110 and 1120 and the cutter arm 1301 to their respective retracted positions, as block 2024 indicates. The leading surface of the case C contacts the front roller 1120 of the tape cartridge 1000 as the front roller arm 1110 is moving to its retracted position, which causes the tape positioned on the front roller 1120 to adhere to the leading surface of the case C. When the front and rear roller arms 1110 and 1210 are in their retracted positions, the front and rear rollers 1120 and 1220 are positioned so they apply enough pressure to the tape to adhere the tape to the top surface of the case C. When the cutter arm 1301 is in its retracted position, the cutter arm 1301 does not contact the top surface of the case C (though in certain embodiments it may do so). The controller 90 controls the roller-arm actuator 1710 and the cutter-arm actuator 1810 to retain the front and rear roller arms 1110 and 1210 and the cutter arm 1301 in their respective retracted positions as the top- and lower drive assemblies 320 and 115 move the case C past the tape cartridges 1000*a* and 1000*b*.

The case C eventually moves off of the infeed table 112, at which point the infeed-table sensor S1 stops detecting the case C and sends a corresponding case-undetected signal to the controller 90. Responsive to receiving that case-undetected signal, the controller 90 controls the side-rail actuator 117 to move the side rails 114*a* and 114*b* from the centering configuration to the rest configuration to make space on the infeed table 112 for the next case to-be-sealed.

At some point, the case-exit sensor S6 detects the presence of the case C, as block 2026 indicates (though this may occur after the retraction sensor S5 stops detecting the case C depending on the length of the case), and sends a corresponding case-detected signal to the controller 90.

Once the case C moves past the case lifter 210, the case-lifter sensor S4 stops detecting the case C and sends a corresponding case-undetected signal to the controller 90, as block 2028 indicates. Responsive to receiving that case-undetected signal, the controller 90 controls the case-lifter actuator 240 to move the case lifter 210 from its retracted position to its case-lifting position in preparation for the next case to-be-sealed.

Once the arm-retraction sensor S5 stops detecting the case (indicating that the case has moved past the arm-retraction sensor S5), the arm retraction sensor S5 sends a corresponding case-undetected signal to the controller 90, as block 2032 indicates. In response, the controller 90 controls the roller-arm actuator 1710 to return the first and second roller arms 1110 and 1120 to their respective extended positions to apply tape to the trailing surface of the case and controls the cutter-arm actuator 1810 to return the cutter arm 1301 to its extended position to cut the tape from the roll, as blocks 2034 and 2036 indicate. As this occurs, the finger 1344 of the cutting-device cover 1340 contacts the top surface of the case so the cutting-device cover 1340 pivots to the open position and exposes the cutting device 1330. Continued movement of the cutter arm 1301 brings the toothed blade of the cutting device 1330 into contact with the tape and severs the tape from the roll R. As the front and rear roller arms 1110 and 1210 move back to their extended positions, the rear roller arm 1210 moves so the rear roller 1220 contacts the severed end of the tape and applies the tape to the trailing surface of the case C to complete the taping process.

The upper and lower drive assemblies 420 and 115 continue to move the case C until it exits from beneath the top-head assembly 400 onto the outfeed table 113, at which point the case-exit sensor S6 stops detecting the case, as block 2038 indicates, and sends a corresponding case-undetected signal to the controller 90. The top-head assembly 400 then descends back to its initial position, as block 2040 indicates.

The case lifter solves the above-identified problems. The fact that the case lifter acts as a ramp (when in its case-lifting position) that lifts the case above the lower drive elements as it reaches the holding position eliminates the need for operators to hold cases in place against the constant pull of the lower drive elements while waiting for the top-head assembly to descend. And the inclusion of the case blocker on the case lifter ensures cases stop at the holding position and don't move too far beneath the top-head assembly before it has descended to within a designated distance of the top surface of the case.

In some embodiments, the tape cartridge includes biasing elements that bias the roller arms and the cutter arm to their respective extended positions. The biasing elements eliminate the need for direct actuation of the roller arms and the cutter arm from their respective retracted positions to their respective extended positions.

In certain embodiments, the controller is separate from and in addition to the sensors. In other embodiments, the sensors act as their own controllers. For instance, in one embodiment, the retraction sensor is configured to directly control the cutter and roller arm actuators responsive to detecting the presence of and the absence of the case, the infeed-table sensor is configured to directly control the side rail actuator responsive to detecting the presence of and the absence of the case, and the leading-surface and top-surface sensors are configured to directly control the top head actuator responsive to detecting the presence of and the absence of the case (or contact with the case).

In certain embodiments, the case lifter does not include the case blocker.

In certain embodiments, rather than being an element extending from the case-engaging surface of the case lifter, the case blocker includes a groove defined in the case-engaging surface of the case lifter. In these embodiments, the groove is sized and shaped to "catch" the bottom corner of the leading surface of the case as that corner rides along the case-engaging surface and reaches the holding position.

In other embodiments, when the case-entry sensor detects the presence of the case beneath the top-head assembly and in response sends a corresponding case-detected signal to the controller, the controller stops driving the lower drive elements (and in certain embodiments the upper drive elements). Afterwards, when the case-lifter sensor detects the case and in response sends a corresponding case-detected signal to the controller, the controller begins driving the lower drive elements (and in certain embodiments the upper drive elements). Stopping the drive elements provides backup to prevent the case from being pushed too far beneath the top-head assembly in the event that the case lifter is not in its blocking position when a case is being moved beneath the top-head assembly or prematurely moves to its retracted position. In certain of these embodiments, the case sealer does not include the case-lifter assembly, and the case-lifter sensor is a drive-stopping sensor.

The invention claimed is:

1. A case sealer comprising:

a frame;

a top-head assembly;

a top-head-assembly actuator operably connected to the top-head assembly and configured to move the top-head assembly relative to the frame;

a tape cartridge supported by the top-head assembly;

a lower drive element;

a lower-drive-element actuator operably connected to and configured to drive the lower drive element;

a case lifter upstream of the tape cartridge and movable relative to the lower drive element between a case-lifting position in which a portion of the case lifter is above a top surface of the lower drive element and a retracted position in which the portion of the case lifter is not above the top surface of the lower drive element, wherein when the case lifter is in the case-lifting position, the portion of the case lifter forms a ramp oriented to, as a leading end of a case is moved onto the case lifter, lift the leading end of the case such that part of a lower surface of the case is lifted above and out of contact with the lower drive element;

a case-lifter actuator operably connected to the case lifter and configured to move the case lifter;

a case-lifter sensor configured to detect a case beneath the top-head assembly and configured to transmit a case-detected signal responsive to detecting the case; and a controller communicatively connected to the case-lifter sensor and operably connected to the case-lifter actuator, the controller configured to, responsive to receiving the case-detected signal from the case-lifter sensor, control the case-lifter actuator to cause the case lifter to move from the case-lifting position to the retracted position such that the part of the lower surface of the case contacts the lower drive element and the lower drive element moves the case past the tape cartridge such that the tape cartridge applies tape to the case.

2. The case sealer of claim 1, wherein the case lifter is pivotable relative to the lower drive element between the case-lifting and retracted positions.

3. The case sealer of claim 2, wherein the frame at least partially defines an infeed end and an outfeed end of the case sealer, wherein the case lifter pivots away from the infeed end and toward the outfeed end when pivoting from the case-lifting position to the retracted position.

4. The case sealer of claim 1, wherein the case-lifter actuator is configured to move the case lifter from the retracted position to the case-lifting position.

5. The case sealer of claim 1, wherein the case-lifter sensor is further configured to transmit a case-undetected signal responsive to no longer detecting the case, wherein the controller is further configured to, responsive to receiving the case-undetected signal from the case-lifter sensor after receiving the case-detected signal from the case-lifter sensor, cause the case lifter to move from the retracted position to the case-lifting position.

6. The case sealer of claim 5, wherein the case lifter is biased to the case-lifting position.

7. The case sealer of claim 5, wherein the case-lifter actuator is operably connected to the case lifter to move the case lifter from the retracted position to the case-lifting position, wherein the case-lifter sensor is configured to transmit a case-undetected signal to the controller responsive to no longer detecting the case, wherein the controller is further configured to, responsive to receiving the case-undetected signal from the case-lifter sensor, control the case-lifter actuator to move the case lifter from the retracted position to the case-lifting position.

8. The case sealer of claim 1, wherein the case-lifter sensor is configured to detect the case within a designated distance of the top-head assembly.

9. The case sealer of claim 1, wherein the lower drive element comprises a first lower drive element, further comprising a second lower drive element spaced-apart from the first lower drive element, wherein the case lifter is between the first and second lower drive elements.

10. The case sealer of claim 1, wherein the portion of the case lifter comprises a case-engaging surface, wherein the case lifter further comprises a case blocker positioned above the top surface of the lower drive element when the case lifter is in the case-lifting position and not above the top surface of the lower drive element when the case lifter is in the retracted position.

11. The case sealer of claim 10, wherein the case blocker extends from the case-engaging surface of the case lifter.

12. The case sealer of claim 1, wherein the case-lifter sensor is positioned on an underside of the top-head assembly.

13. The case sealer of claim 12, wherein the case-lifter sensor comprises a proximity sensor.

* * * * *